US007218051B2

(12) United States Patent
Machida

(10) Patent No.: US 7,218,051 B2
(45) Date of Patent: May 15, 2007

(54) DISCHARGE TUBE

(75) Inventor: Kazuhiko Machida, Nagano (JP)

(73) Assignee: Shinko Electric Industries Co., Ltd., Nagano (JP)

( * ) Notice: Subject to any disclaimer, the term of this patent is extended or adjusted under 35 U.S.C. 154(b) by 111 days.

(21) Appl. No.: 10/747,579

(22) Filed: Dec. 29, 2003

(65) Prior Publication Data

US 2004/0155586 A1 Aug. 12, 2004

(30) Foreign Application Priority Data

Jan. 9, 2003 (JP) ..... 2003-003505

(51) Int. Cl.
*H01J 61/54* (2006.01)
*H01J 17/30* (2006.01)

(52) U.S. Cl. ..... 313/602; 313/601

(58) Field of Classification Search ..... 313/595–603, 313/306–308; 361/120, 129
See application file for complete search history.

(56) References Cited

U.S. PATENT DOCUMENTS 3,042,828 A * 7/1962 Josephson ..... 313/634
3,588,576 A * 6/1971 Kawiecki ..... 313/306
3,711,741 A * 1/1973 Akiyama et al. ..... 315/241 P
4,491,893 A * 1/1985 Toda ..... 313/318.02
6,025,672 A * 2/2000 Machida ..... 313/231.11
6,313,581 B1 * 11/2001 Machida ..... 313/603
6,430,018 B1 * 8/2002 Machida ..... 361/120

FOREIGN PATENT DOCUMENTS

| | | |
|---|---|---|
| EP | 0869529 | 10/1998 |
| JP | 645048 | 2/1994 |
| JP | 10-335042 | 12/1998 |
| JP | 2001023576 | 1/2001 |
| JP | 2001035446 | 2/2001 |
| JP | 2001093644 | 4/2001 |
| JP | 2002270331 | 9/2002 |

OTHER PUBLICATIONS

Japenese Patent Office Action.

* cited by examiner

*Primary Examiner*—Ashok Patel
*Assistant Examiner*—Christopher M. Raabe
(74) *Attorney, Agent, or Firm*—Ladas & Parry LLP

(57) ABSTRACT

A discharge tube includes a cylinder having first and second end planes, first and second discharge electrodes coupled to the respective first and second end planes, the first and second discharge electrodes having respective upper and lower discharge planes forming therebetween a discharge gap, and one or more discharge trigger wires disposed in a portion of the cylinder that encompasses the discharge gap.

10 Claims, 23 Drawing Sheets

DISCHARGE TUBE

BACKGROUND OF THE INVENTION

1. Field of the Invention

The present invention relates generally to a discharge tube, and more particularly to a discharge tube which discharges between a discharge plane of an upper discharge electrode and a discharge plane of a lower discharge electrode, at the center of an airtight cylinder.

2. Description of the Related Art

Japanese Laid-Open Patent Application No. 10-335042 shows an example of a discharge tube used in, for example, a ballast circuit for igniting an HID (High Intensity Discharge) lamp of a vehicle, or an igniter circuit for igniting a rear side lamp of a liquid crystal projector. This discharge tube (discharge tube 1A), shown in FIGS. 1 to 3, includes, for example, an airtight cylinder 10 formed into a cylindrical shape from an insulating material, an upper discharge electrode 22 joined to an upper opening part of the airtight cylinder 10 shown in FIG. 1, and a lower discharge electrode 24 joined to a lower opening part of the airtight cylinder 10 shown in FIG. 1.

Four main discharge trigger wires 80, being transversely formed at a middle section of the inner wall of the airtight cylinder 10, are aligned with a prescribed interval in an upright manner in a direction parallel to the axis of the airtight cylinder 10. Four sub-discharge trigger wires 90, being formed at upper and lower sections of the inner wall of the airtight cylinder 10, are aligned between the main discharge trigger wires 80 in an upright manner in a direction parallel to the axis of the airtight cylinder 10. The upper and lower ends of the sub-discharge trigger wires 90 are connected to a metallized plane 40 formed on an upper end surface and a lower end surface of the airtight cylinder 10.

In the discharge tube 1A, sputter, being created during discharge from a discharge plane of a distal end of the upper discharge electrode 22 (hereinafter referred to as "upper discharge plane 23") and a discharge plane of the lower end of the lower discharge electrode 24 (hereinafter referred to as "lower discharge plane 25"), adheres to the middle section of the inner wall of the airtight cylinder, to thereby prevent the insulating properties of the main discharge trigger wire 80 and the sub-discharge trigger wire 90 from deteriorating. Therefore, an electrical discharge can be repeatedly and steadily induced at a prescribed potential for a long period between the upper discharge plane 23 and the lower discharge plane 25.

FIG. 7 shows the data of the electrical discharge property of the discharge tube 1A in a case where a single unit of the discharge tube 1A is activated under an ideal environment that is free from being affected by, for example, an external magnetic field. FIG. 7 shows that a stable arc discharge is repeatedly induced in a regular manner. It is to be noted that the horizontal axis indicates time and the vertical axis indicates discharge voltage (1 square space represents 1000 V) in FIG. 7 and also in the other diagrams given below that show data of an electrical discharge property.

Along with the accelerating trend of mobilization of liquid crystal projectors in recent years, electronic devices and circuits that are mounted to the liquid crystal projectors tend to be size-reduced and disposed in high density. Further, respective electronic devices and electronic components are also packaged in high density.

The discharge tube 1A may be, therefore, disposed in the proximity of a booster coil 2 (hereinafter referred to as "coil") (see FIG. 4) that serves to boost an AC 100V commercial power supply to 3000V or more, or in the proximity of a power transformer 4 (hereinafter referred to as "transformer") (see FIG. 5). Furthermore, the discharge tube 1A may be situated between the coil 2 and the transformer 4 depending on the layout of the components.

By disposing the discharge tube 1A proximal to the coil 2 or the transformer 4 in the manner described above, the coiling direction of the coil 2 or the transformer 4 will be substantially perpendicular to the main discharge trigger wire 80 or the sub-discharge trigger wire 90 of the discharge tube 1A. This causes the magnetic field or the electromagnetic waves generated by the coil 2 and the transformer 4 to affect the discharge tube 1A, and create an electric current in the main discharge trigger wire 80 and the sub-discharge trigger wire 90 by electromagnetic induction. As a result, the discharge tube 1A is liable to malfunction.

An experiment for obtaining electrical discharge property data was conducted in a case where: ① the discharge tube 1A is situated in the proximity of the coil 2 (a coil boosting the AC 100V commercial power supply to 4000V or more) as shown in FIG. 4, ② the discharge tube 1A is situated in the proximity of the transformer 4 as shown in FIG. 5, and ③ the discharge tube 1A is situated between the coil 2 and the transformer 4 as shown in FIG. 6, respectively.

It is to be noted that the term "proximity" in the experimental cases of ① and ② refers to a position that is no more than 2 mm apart from the coil 2 and the transformer 4.

FIG. 8 shows the electrical discharge property data in the case of ① where the discharge tube 1A is situated in the proximity of the coil 2, FIG. 9 shows the electrical discharge property data in the case of ② where the discharge tube 1A is situated in the proximity of the transformer 4, and FIG. 10 shows the electrical discharge property data in the case of ③ where the discharge tube 1A is situated between the coil 2 and the transformer 4.

In comparing the electrical discharge property data of the discharge tube 1A in FIG. 7 with the electrical discharge property data of the discharge tube 1A in FIGS. 8 to 10, the data in FIGS. 8 to 10 show an unstable electric potential of discharge that largely fluctuates.

Such instability and fluctuation are caused by the discharge tube 1A being affected by the electric field and the electromagnetic wave generated from the coil 2 and the transformer 4.

This large fluctuation may become the cause for miss-fire and may prevent the discharge tube 1A from suitably driving, for example, a liquid crystal projector.

SUMMARY OF THE INVENTION

It is a general object of the present invention to provide a discharge tube that substantially obviates one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by a discharge tube particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides a discharge tube including: a cylinder having first and second end planes; first and second discharge electrodes coupled to the respective first and second end planes, the first and second discharge electrodes having respective upper and lower discharge planes forming therebetween a discharge gap; and one or more discharge trigger wires disposed in a portion of the cylinder that encompasses the discharge gap. Furthermore, in the discharge tube according to the present invention, at least one of the discharge trigger wires may have a ring shape. Furthermore, in the discharge tube according to the present invention, the one or more discharge trigger wires may be disposed in a center portion of the cylinder. Furthermore, in the discharge tube according to the present invention, the one or more discharge trigger wires may be disposed in an area facing the discharge gap.

In an embodiment of the present invention, by forming one or more ring-shaped discharge trigger wires in the area facing the discharge gap, the ring-shaped discharge trigger wires can be situated on the plane that perpendicularly intersects with the axial direction of the airtight cylinder. Accordingly, even when the discharge tube is situated in the proximity of a coil, the plane of the ring shape discharge trigger wires may be substantially parallel to the coiling direction (plane) of the coil.

Therefore, even where the magnetic field of the electromagnetic wave from the coil has an effect on the discharge tube, the ring-shaped discharge trigger wire can restrain the current generated from induction to a minimal amount, and can stabilize the electric potential of the discharge that is repeatedly induced by the discharge tube.

In the discharge tube according to the present invention, the discharge tube may be situated no more than 2 mm from a coil.

In an embodiment of the present invention, by disposing the discharge tube in a position no more than 2 mm from the coil, a more effective stable electrical discharge can be attained.

In the discharge tube according to the present invention, the one or more discharge trigger wires may comprise a plurality of discharge trigger wires and each of the discharge trigger wires may have a dash shape.

In an embodiment of the present invention, by forming a plurality of dash-shaped discharge trigger wires in an area facing the discharge gap, and evenly spacing them from each other, even where the magnetic field of the electromagnetic wave from a transformer has an effect on the discharge tube, the dash-shaped discharge trigger wire can restrain the current generated from induction to a minimal amount, and can stabilize the electric potential of the electrical discharges that-are repeatedly induced by the discharge tube.

In the discharge tube according to the present invention, the length of each of the discharge trigger wires may be no more than 2 mm and no less than 0.3 mm.

In an embodiment of the present invention, by forming the length of the dash-shaped discharge trigger wire to no more than 2 mm and no less than 0.3 mm, the electric potential of the electrical discharges that are repeatedly induced by the discharge tube can be stabilized more effectively.

In the discharge tube according to the present invention, the discharge tube may be situated no more than 2 mm from a transformer.

In an embodiment of the present invention, by disposing the discharge tube in a position no more than 2 mm from the transformer, a more effective stable electrical discharge can be attained.

In the discharge tube according to the present invention, the one or more discharge trigger wires may comprise a plurality of discharge trigger wires and each of the discharge trigger wires may have a dot shape.

In an embodiment of the present invention, by forming a plurality of dot-shaped discharge trigger wires in an area facing the discharge gap, and evenly spacing them from each other, even where the magnetic field of the electromagnetic wave from a coil and a transformer have an effect on the discharge tube, the dot-shaped discharge trigger wire can restrain the current generated from electromagnetic induction to a minimal amount, and can stabilize the electric potential of the electrical discharges that are repeatedly induced by the discharge tube.

In the discharge tube according to the present invention, the diameter of each of the discharge trigger wires may be no more than 2 mm and no less than 0.3 mm.

In an embodiment of the present invention, by forming each of the dot-shaped discharge trigger wires with a diameter of no more than 2 mm and no less than 0.3 mm, the electric potential of the electrical discharges that are repeatedly induced by the discharge tube can be stabilized more effectively.

In the discharge tube according to the present invention, the discharge tube may be situated between a coil and a transformer, in a distance of no more than 2 mm from the coil and the transformer.

In an embodiment of the present invention, by disposing the discharge tube between the coil and the transformer, in a distance of no more than 2 mm from the coil and the transformer, a more effective stable electrical discharge can be attained.

In the discharge tube according to the present invention, a relation of $A \leqq 2 \times B$ may be satisfied in a case where A is the distance of the space between the upper and lower discharge planes, and B is the distance from the discharge trigger wire to the upper discharge plane or the lower discharge plane.

In an embodiment of the present invention, by satisfying a relation of $A \leqq 2 \times B$ in a case where A is the space between the upper discharge plane of the first discharge electrode and the lower discharge plane of the second discharge electrode, and B is the distance from the discharge trigger wire to the upper discharge plane or the lower discharge plane, even where sputter adheres to the inner wall portion of the airtight cylinder at a time of discharge, the sputter will not adversely affect the discharge generated in the discharge gap. Accordingly, electric potential of the electrical discharges that are repeatedly induced in the discharge gap can be stabilized.

Furthermore, the present invention provides a discharge tube including: a cylinder having first and second end planes and an inner wall; and first and second discharge electrodes coupled to the respective first and second end planes, the first and second discharge electrodes having respective upper and lower discharge planes; wherein a relation of $A \leqq 2 \times C$ is satisfied in a case where A is the distance between the upper and lower discharge planes, and C is the distance from the inner wall of the cylinder to the upper discharge plane or the lower discharge plane. Furthermore, in the discharge tube according to the present invention, the upper and lower discharge planes may form a discharge gap therebetween, and further may include one or more discharge trigger wires disposed in a portion that encompasses the discharge gap.

In an embodiment of the present invention, by satisfying a relation of $A \leqq 2 \times C$ in a case where A is the space between the upper discharge plane and the lower discharge plane, and C is the distance from the inner wall of the airtight cylinder to the upper discharge plane or the lower discharge plane, even where sputter adheres to the inner wall portion of the airtight cylinder at a time of discharge, the sputter will not adversely affect the discharge generated in the discharge gap. Accordingly, electric potential of the electrical discharges that are repeatedly induced in the discharge gap can be stabilized.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 11:
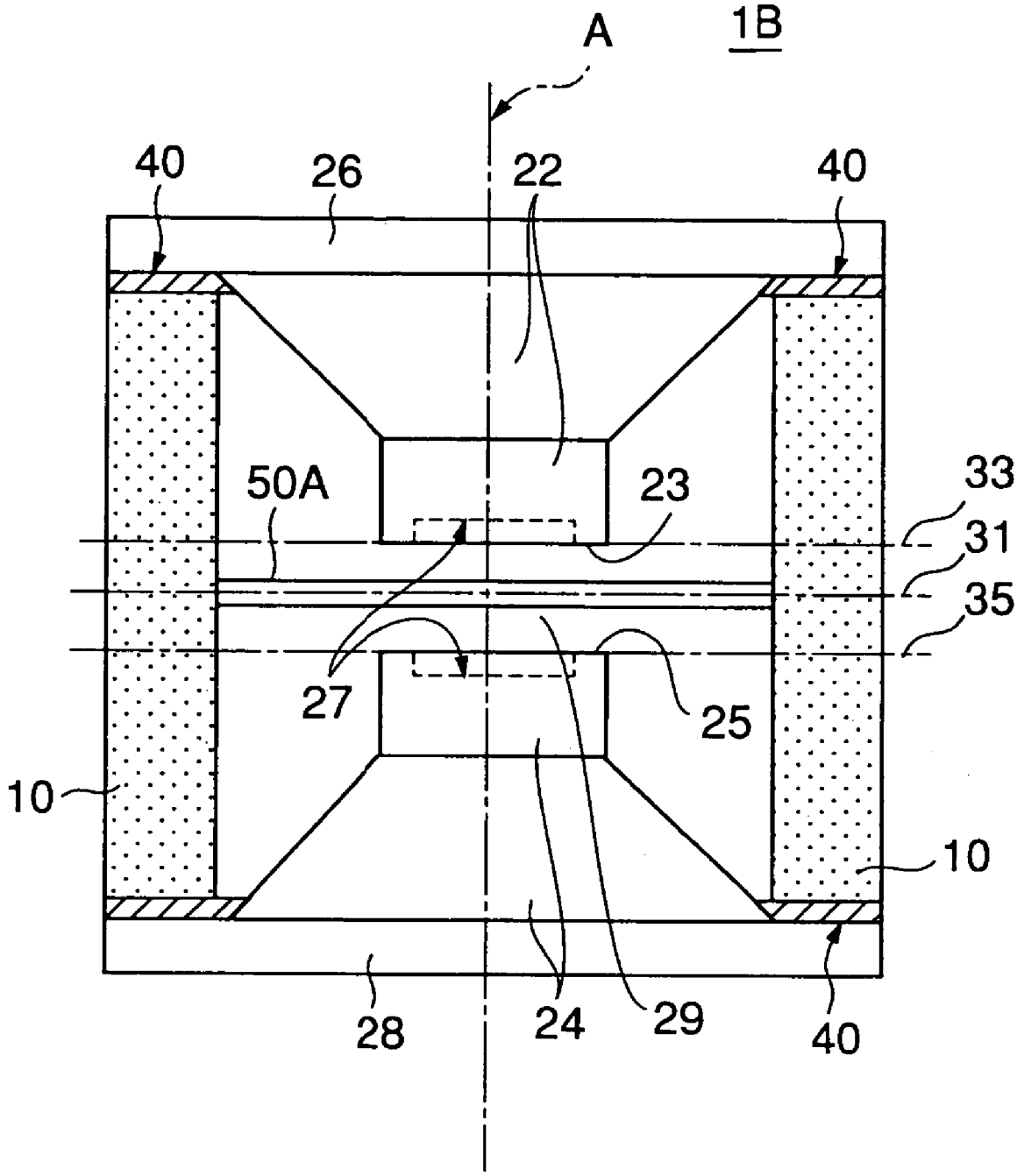
FIG. 11 is a cross-sectional view showing a discharge tube according to a first embodiment of the present invention.
Figure 12:
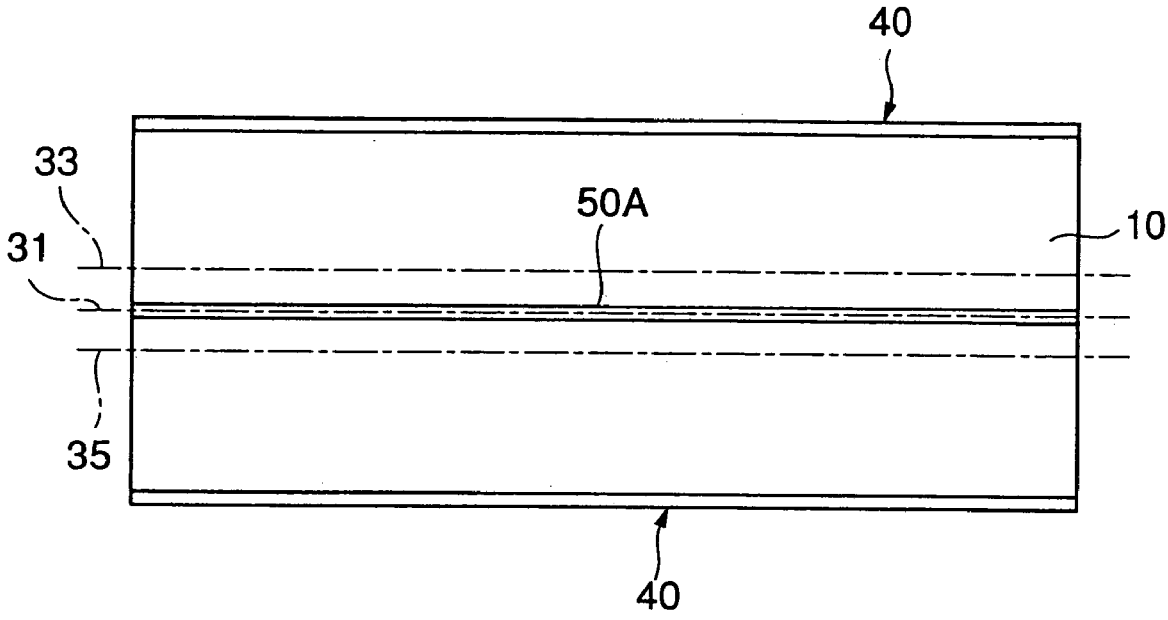
FIG. 12 is a developed view showing an inner wall of an airtight cylinder of the discharge tube shown in FIG. 11.

FIG. 11 is a cross-sectional view showing a discharge tube 1B according to a first embodiment of the present invention, and FIG. 12 is a developed view showing an inner wall of an airtight cylinder 10 of the discharge tube 11. It is to be noted that, in the description of the embodiments of the present invention, like components are denoted by like numerals as of the aforementioned structure shown in FIGS. 1 to 6.

The discharge tube 1B includes, for example, an airtight cylinder 10, an upper discharge electrode 22, and a lower discharge electrode 24. The airtight cylinder 10 is cylindrically shaped and formed from an insulating material such as ceramic. The upper discharge electrode 22 and the lower discharge electrode 24, which are both formed of a metal material such as 42 alloy (e.g. iron-nickel alloy), are joined to the upper end opening part and the lower end opening part of the airtight cylinder 10, respectively.

That is, disk-shaped lid members 26, 28 are integrally formed to the upper discharge electrode 22 and the lower discharge electrode 24. Further, metallized planes 40 are formed to the upper end opening part and the lower end opening part of the airtight cylinder 10. Accordingly, the upper discharge electrode 22 and the lower discharge electrode 24 are joined to the airtight cylinder 10 by soldering the lid members 26, 28 of each of the discharge electrodes 22, 24 with the metallized planes 40 formed at the upper and lower opening parts of the airtight cylinder 10.

During this joining process, a mixed gas (e.g. inert gas) is sealed inside the airtight cylinder 10. The mixed gas sealed inside the airtight cylinder 10 can be air-tightly sealed in the airtight cylinder 10 by joining the upper discharge electrode 22 and the upper discharge plane 23.

The upper discharge electrode 22, projecting from the lid member 26 in a direction toward the center of the airtight cylinder 10, has a distal end part that is shaped as a cylinder with a small diameter. The upper discharge plane 23 formed on the distal end portion of the upper discharge electrode 22 is provided with a recess part 27 for stably inducing electrical discharge.

Likewise, the lower discharge electrode 24, projecting from the lid member 28 in a direction toward a center portion of the airtight cylinder 10, has a distal end part that is shaped as a cylinder with a small diameter. The lower discharge plane 25 formed on the distal end part of the lower discharge electrode 24 is also provided with a recess part for stably inducing electrical discharge.

The electrical discharge inside the discharge tube 1B is induced at a space portion between the upper discharge plane 23 and the lower discharge plane 25. The space portion between the upper discharge plane 23 and the lower discharge plane 25 is hereinafter referred to as "discharge gap 29". Further, in the description below, ① the plane perpendicularly intersecting with a center axis (illustrated with the dash-dot lines and indicated by arrow A in FIG. 11) of the airtight cylinder 10 and including a center position of the discharge gap 29 (center position with respect to the axial direction) is hereinafter referred to as "first plane 31", ② the plane perpendicularly intersecting with the center axis of the airtight cylinder 10 and including the upper discharge plane 23 is hereinafter referred to as "second plane 33", and ③ the plane perpendicularly intersecting with the center axis of the airtight cylinder 10 and including the lower discharge plane 25 is hereinafter referred to as "third plane 35".

In the discharge tube 1B, a ring-shaped discharge trigger wire 50A, which is a feature of the present embodiment, is disposed in the center portion of the airtight cylinder 10, that is, a portion where the first plane 31 intersects with the inner wall of the airtight cylinder 10. The ring-shaped discharge trigger wire 50A, having a wire width of, for example, approximately 0.5 mm, is formed from a conductive material such as carbon. In the present embodiment, a single discharge trigger wire 50A, which is ring-shaped, is provided traversing substantially in parallel to the metallize planes 40 across the inner wall of the airtight cylinder 10.

Figure 1:
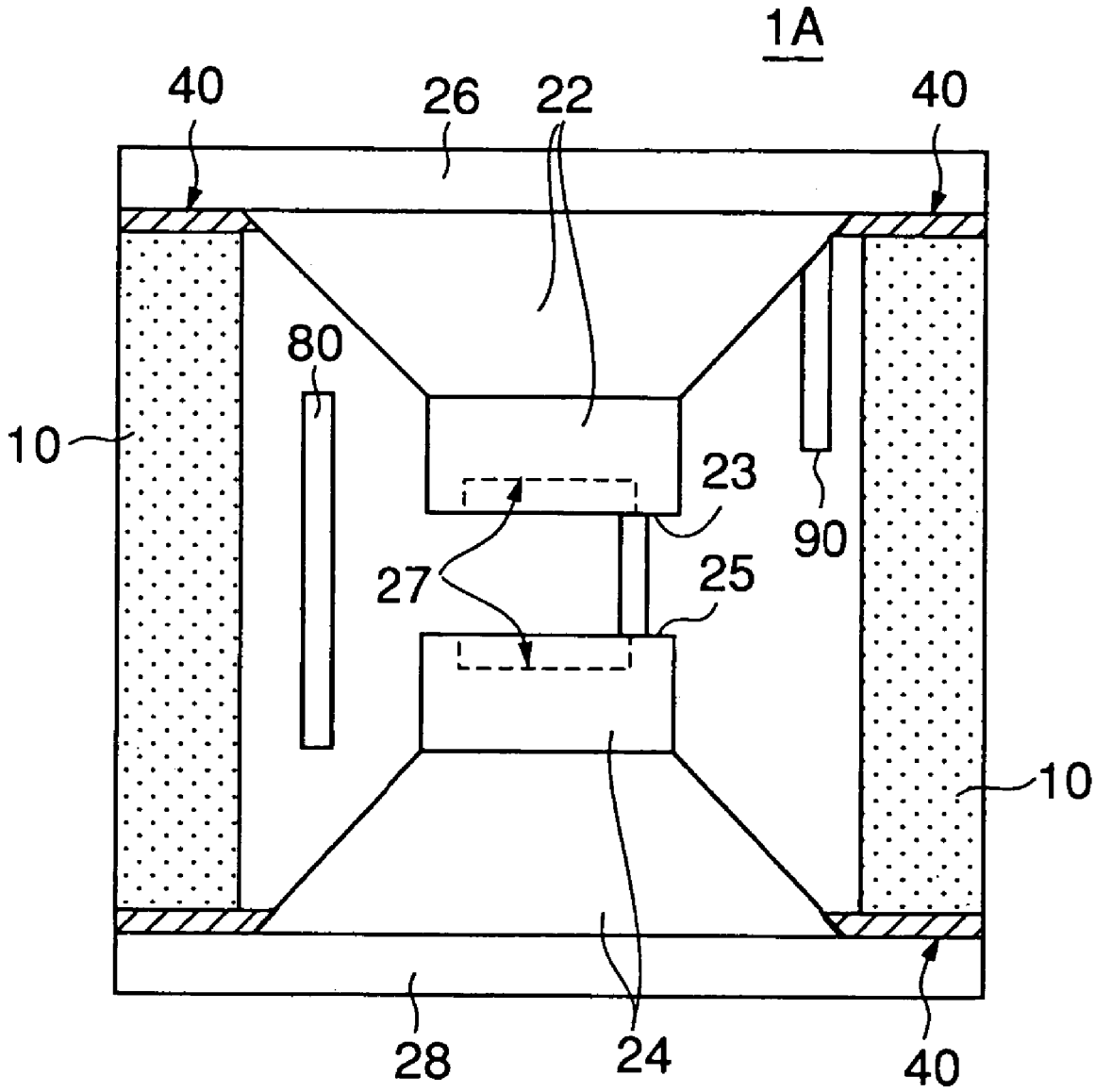
FIG. 1 is a cross-sectional view showing an example of a conventional discharge tube.
Figure 2:
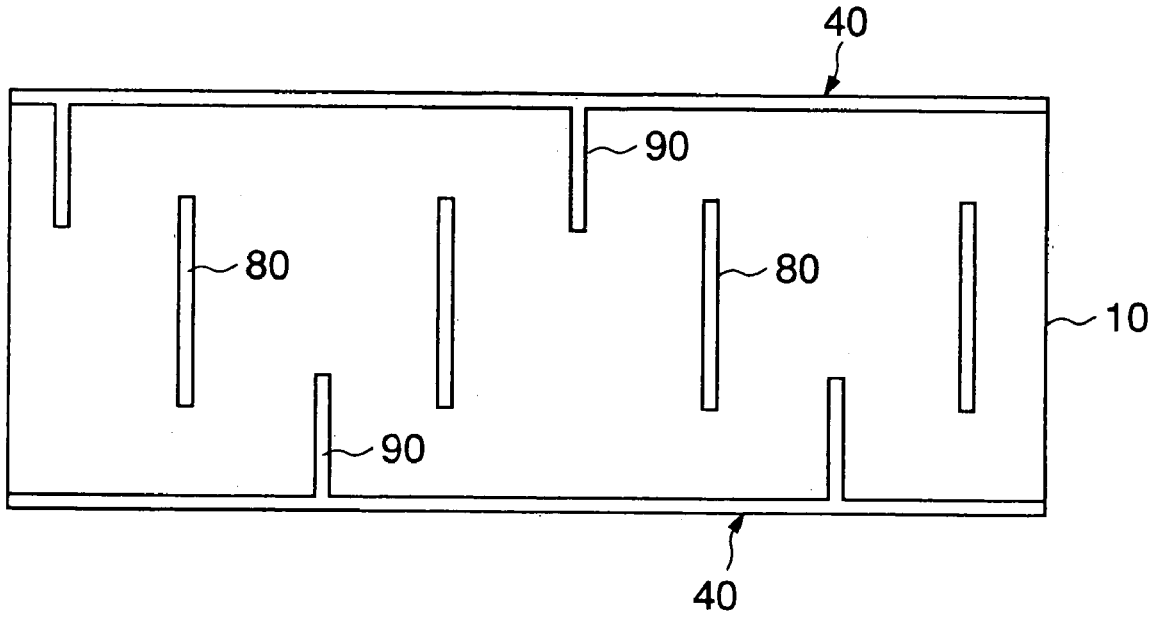
FIG. 2 is a developed view showing an inner wall of an airtight cylinder of the discharge tube shown in FIG. 1.
Figure 3:
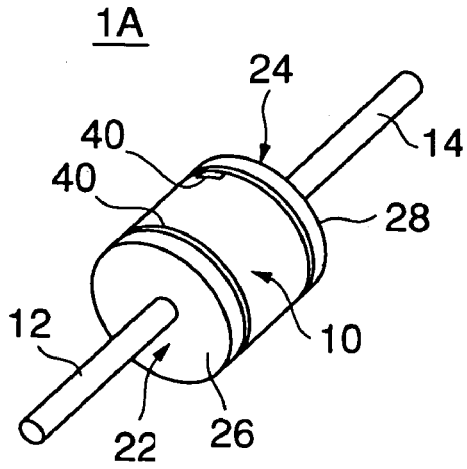
FIG. 3 is a schematic view showing a discharge tube.
Figure 4:
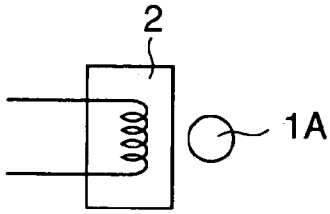
FIG. 4 is a view showing a state where a discharge tube is situated in the proximity of the coil.
Figure 13:
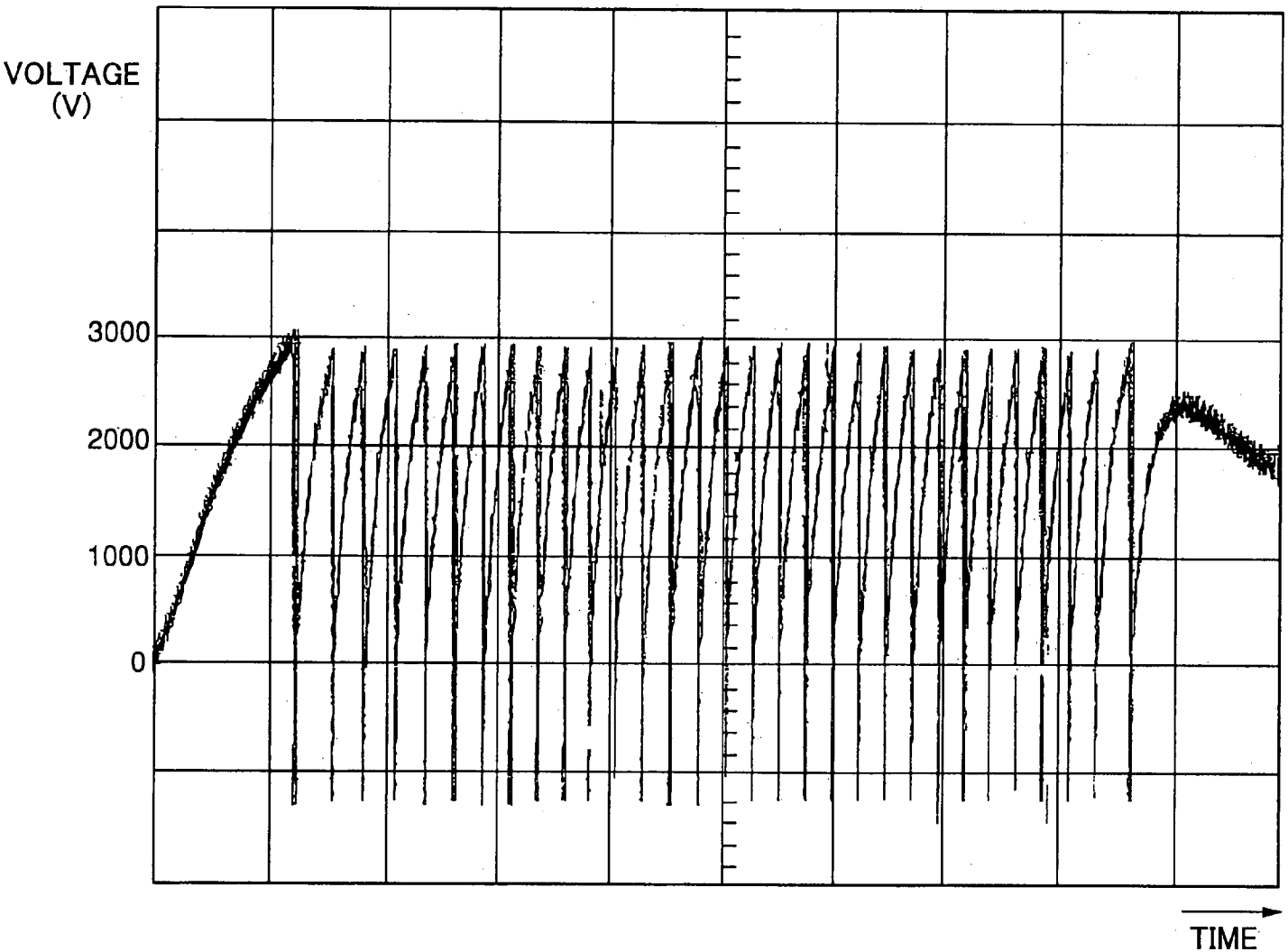
FIG. 13 is a diagram showing electrical discharge property data in a case where a discharge tube according to a first embodiment of the present invention is situated in the proximity of a coil.

FIG. 13 shows the electrical discharge property of the discharge tube 1B where electrical discharge was induced with the discharge tube 1B under the same condition as described in FIG. 4, in which the discharge tube 1B is situated in the proximity of the coil 2.

More specifically, in the illustrated exemplary embodiment, the discharge tube 1B was provided to the coil 2 so that the distance between the discharge tube 1B and the coil 2 may be no more than 2 mm. Further, charge from a condenser was repeatedly applied between the upper discharge electrode 22 and the lower discharge electrode 24 for repeatedly creating arc discharge between the upper discharge plane 23 of the upper discharge electrode 22 and the lower discharge plane 25 of the lower discharge electrode 24. A coil serving to boost an AC 100V commercial power supply to 4000V (a coil typically used for a liquid crystal projector) was employed as the coil 2.

Figure 8:
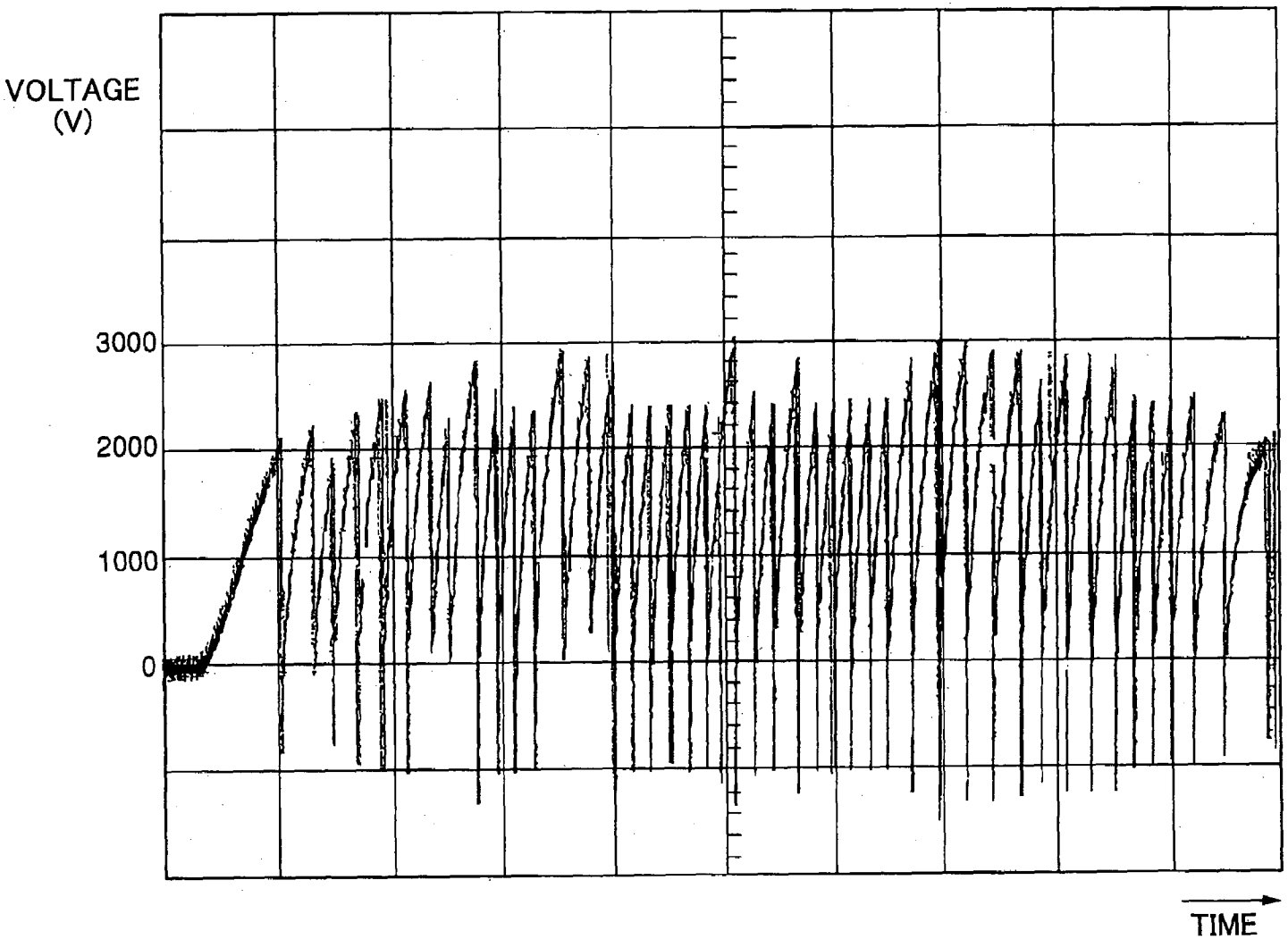
FIG. 8 is a diagram showing electrical discharge property data in a case where a conventional discharge tube is situated in the proximity of a coil.

FIG. 13 shows that the discharge tube 1B of the present embodiment is able to repeatedly and stably induce electrical discharges at a uniform electric potential even when the discharge tube 1B is situated in the proximity of the coil 2. In comparison with the case of the conventional discharge tube 1A shown in FIG. 8, the discharge tube 1B of the present embodiment is able to provide remarkably stable electrical discharges.

The discharge tube 1B of the present embodiment is able to provide such remarkably stable electrical discharges even in the proximity of the coil 2 given that the ring-shaped discharge trigger wire 50A is disposed in a portion where the first plane 31 intersects with the inner wall of the airtight cylinder 10, that is, the center portion of the airtight cylinder 10.

By forming the ring-shaped discharge trigger wire 50A of the present embodiment in the aforementioned manner, the ring-shaped discharge trigger wire 50A is situated on the first plane 31 perpendicularly intersecting with the axis of the airtight cylinder 10. Therefore, the direction (plane) on which the ring-shaped discharge trigger wire 50A is disposed would be substantially parallel to the coil direction (plane) of the coil 2.

Therefore, even where the magnetic field of the electromagnetic wave from the coil 2 may affect the discharge tube 1B, the ring-shaped discharge trigger wire 50A can restrain the current generated by electromagnetic induction to a minimal amount, and can stabilize the electric potential of the electrical discharges that are repeatedly induced by the discharge tube 1B.

Figure 14:
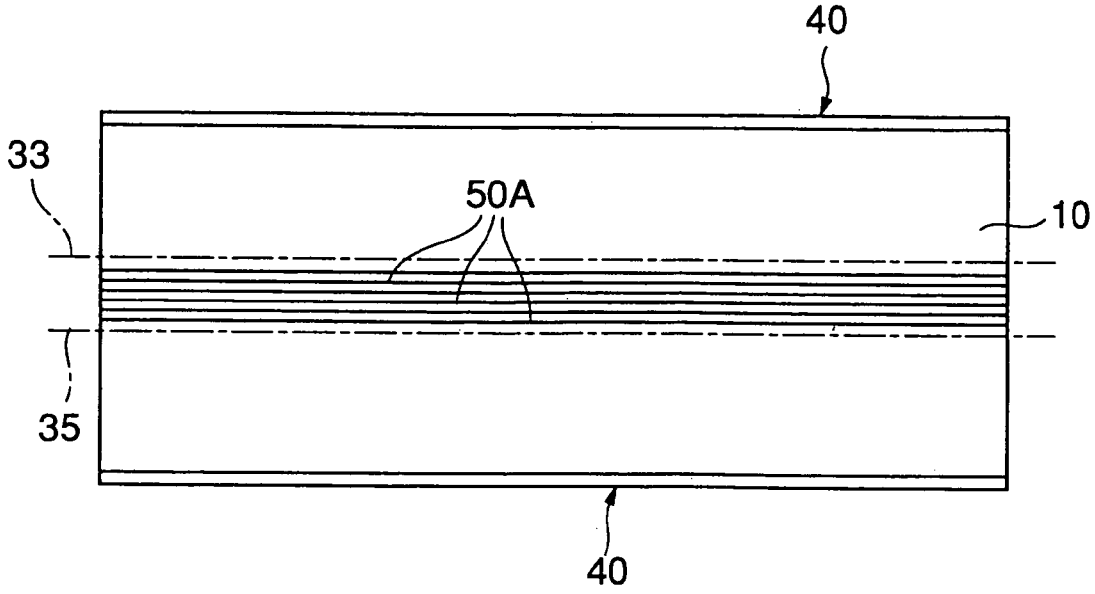
FIG. 14 is a developed view showing an inner wall of an airtight cylinder of a discharge tube according to a modified example of a first embodiment of the present invention.

FIG. 14 is a developed view showing a modified example of the discharge tube 1B of the aforementioned first embodiment. In the modified example, plural ring-shaped discharge trigger wires 50A are disposed in an area facing the discharge gap 29 of the airtight cylinder 10, that is, the space between the second plane 33 and the third plane 35.

In obtaining the electrical discharge property of the modified example, where plural ring-shaped discharge trigger wires 50A are disposed in the area facing the discharge gap 29 of the airtight cylinder 10, an electrical discharge property that is substantially the same as that shown in FIG. 13 was attained. Therefore, the present invention is not limited to the first embodiment where a single ring-shaped discharge trigger wire 50A is disposed in the center portion of the airtight cylinder 10. Instead, one or a plurality of ring-shaped discharge trigger wires may be disposed in the area facing the discharge gap 29 of the airtight cylinder 10, to thereby prevent electric current from being generated from electromagnetic induction in the ring-shaped discharge trigger wire 50A even when exposed to an electric field or electromagnetic waves generated by the coil 2. Accordingly, electric potential of the electric discharges that are repeatedly induced in the discharge gap 29 can be stabilized.

Next, the second embodiment according to the present invention is described below.

Figure 15:
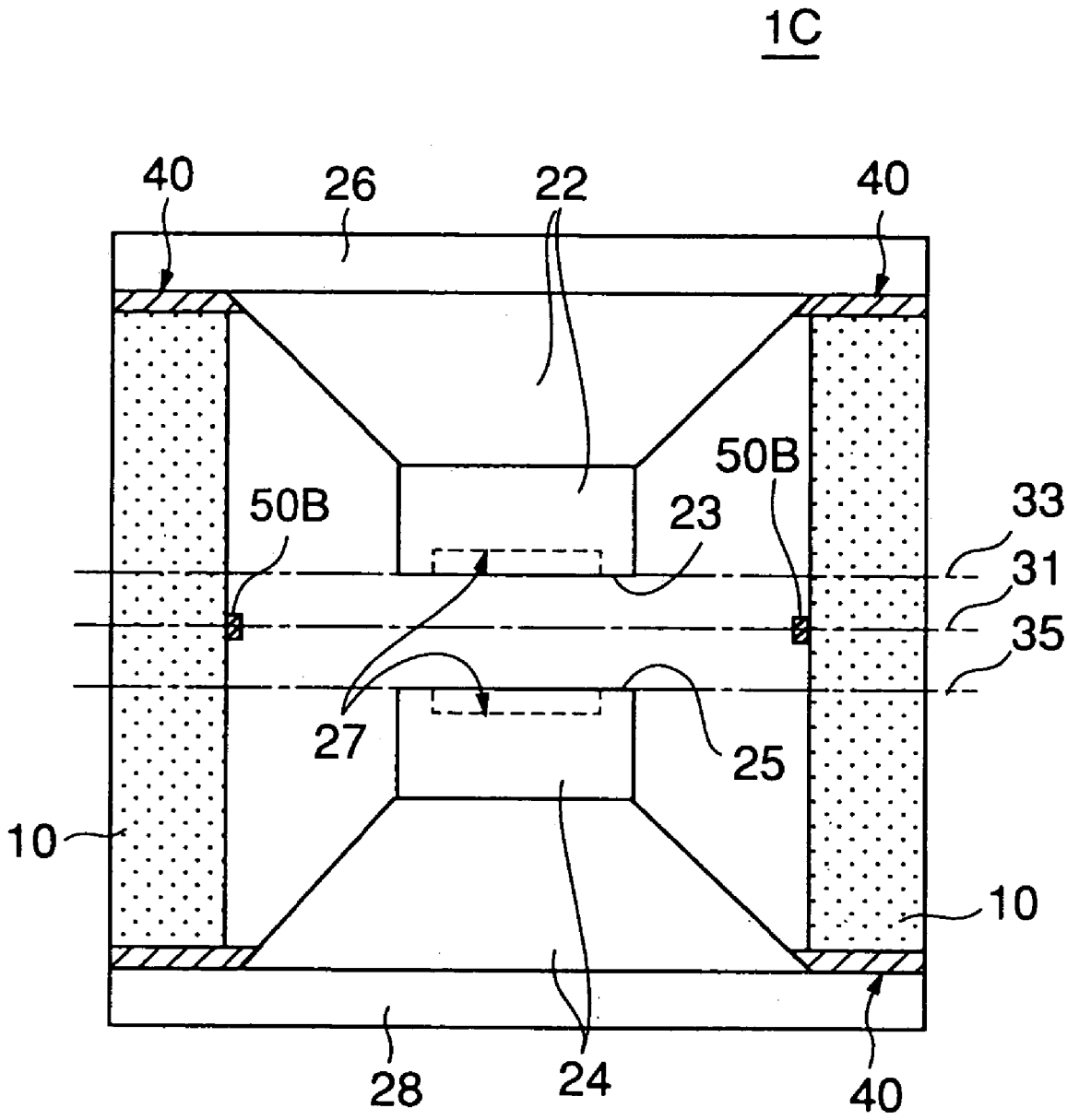
FIG. 15 is a cross-sectional view showing a discharge tube according to a second embodiment of the present invention.
Figure 16:
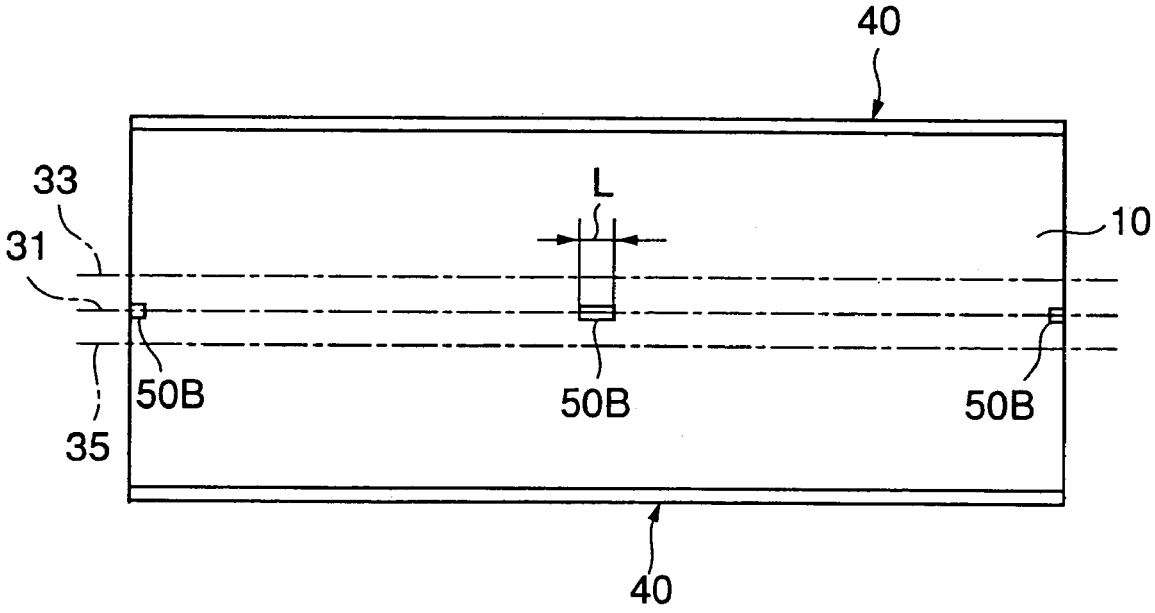
FIG. 16 is a developed view showing an inner wall of an airtight cylinder of the discharge tube shown in FIG. 15.

FIG. 15 is a cross-sectional view showing a discharge tube 1C of the second embodiment according to the present invention, and FIG. 16 is a developed view showing the inner wall of the airtight cylinder 10 of the discharge tube 1C. It is to be noted that, in the description of the second embodiment of the present invention using FIGS. 15, 16 and 18, like components are denoted by like numerals as of the aforementioned first embodiment using FIGS. 11, 12, and 14.

The discharge tube 1C of the present embodiment has a feature of having a plurality of discharge trigger wires 50B in the form of dashes in a portion where the first plane 31 intersects with the inner wall, of the airtight cylinder 10, that is, the center portion of the airtight cylinder 10. In the present embodiment, the discharge trigger wires 50B, which are formed of two dashes, are disposed in an evenly spaced manner with a 180 degree interval, for example.

The dash discharge trigger wires 50B, having a wire width of, for example, approximately 0.5 mm, are formed of a conductive material such as carbon. In addition, the length of the dash discharge trigger wire 50B in the direction of the periphery of the airtight cylinder 10 (length indicated with arrow L in FIG. 16) is, for example, preferably no less than 0.3 mm and no more than 2 mm, so as to obtain a suitable electrical discharge property (described in detail below).

Figure 5:
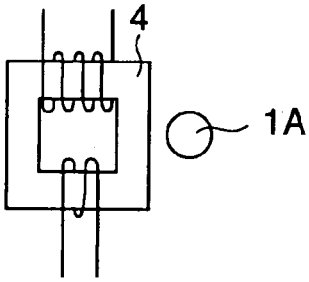
FIG. 5 is a view showing a state where a discharge tube is situated in the proximity of the transformer.
Figure 17:
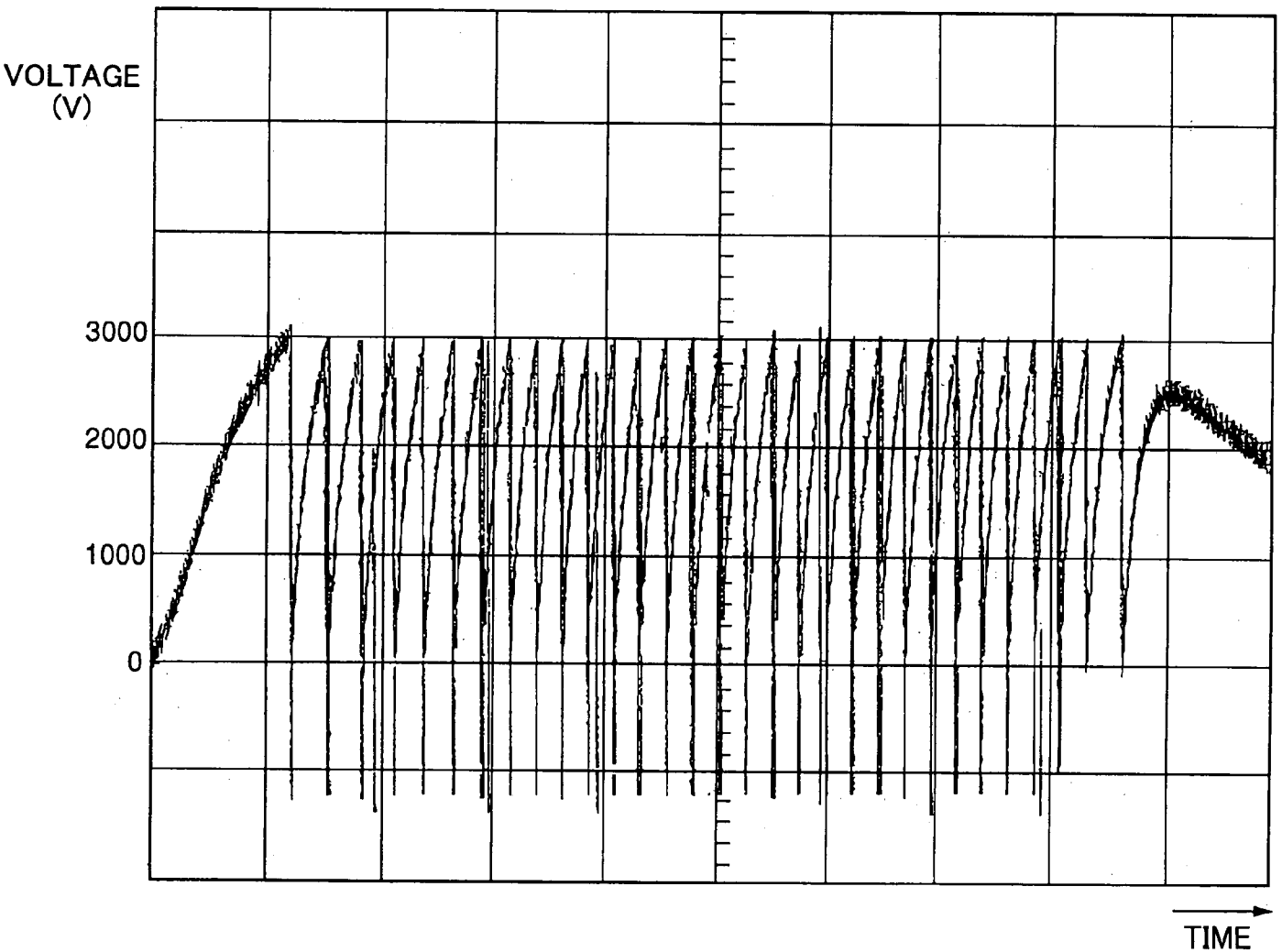
FIG. 17 is a diagram showing electrical discharge property data in a case where a discharge tube according to a second embodiment of the present invention is situated in the proximity of a transformer.

FIG. 17 shows the electrical discharge property of the discharge tube 1C where electrical discharge was induced with the discharge tube 1C under the same condition as described in FIG. 5, in which the discharge tube 1C is situated in the proximity of the transformer 4.

More specifically, the discharge tube 1C is disposed relative to the transformer 4 so that the distance between the discharge tube 1C and the transformer 4 is no more than 2 mm in the illustrated exemplary embodiment. Further, charge from a condenser is repeatedly applied between the upper discharge electrode 22 and the lower discharge electrode 24, to thereby repeatedly generate arc discharge between the upper discharge plane 23 of the upper discharge electrode 22 and the lower discharge plane 25 of the lower discharge electrode 24. A transformer disposed in a liquid crystal projector performing current signal relay and amplification (a transformer typically used for a liquid crystal projector) was employed as the transformer 4.

Figure 9:
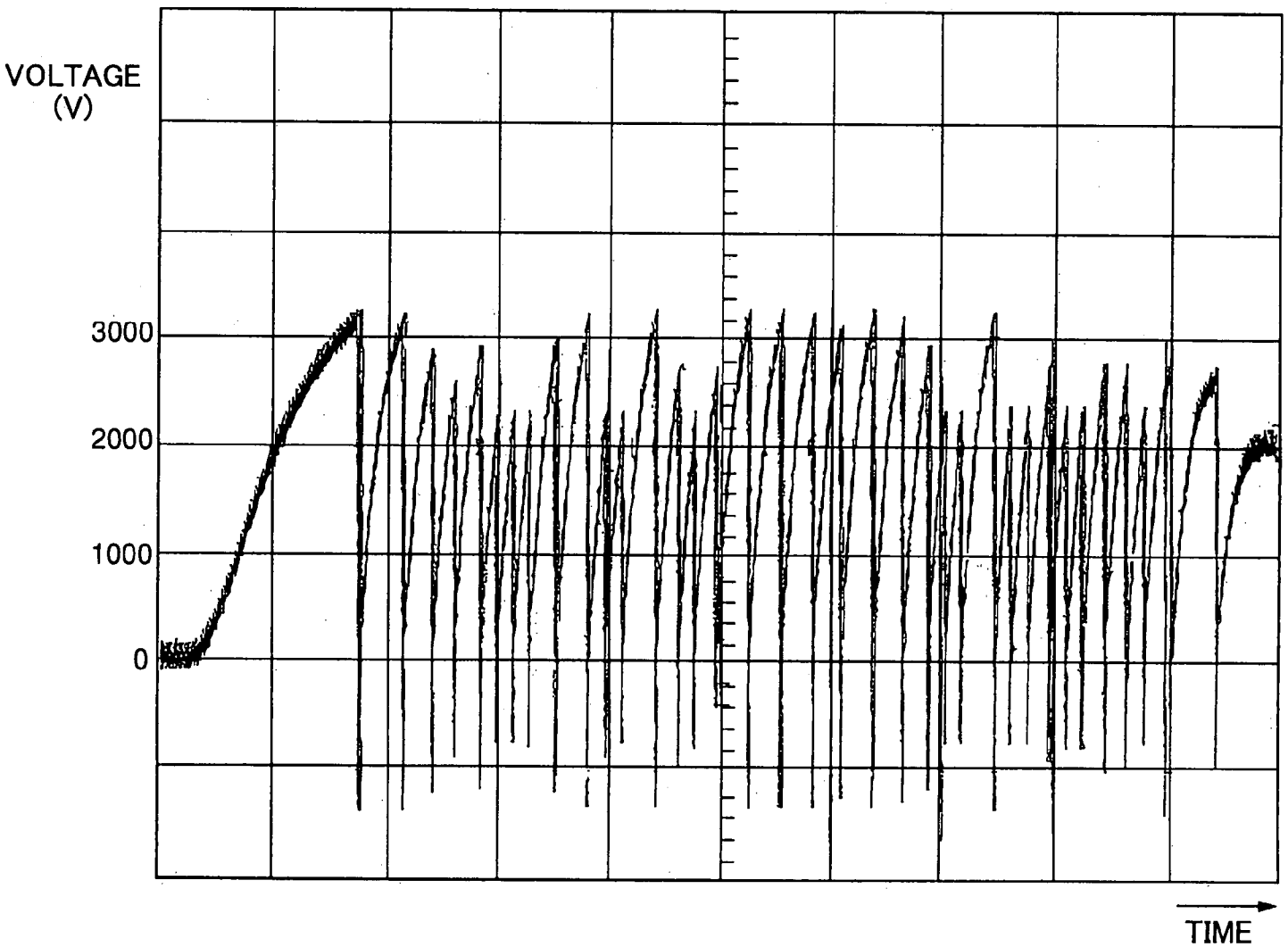
FIG. 9 is a diagram showing electrical discharge property data in a case where a conventional discharge tube is situated in the proximity of a transformer.

FIG. 17 shows that the discharge tube 1C of the present embodiment is able to repeatedly and stably induce electrical discharges at a uniform electric potential even when the discharge tube 1C is situated in the proximity of the transformer 4. In comparison with the case of the conventional discharge tube 1A shown in FIG. 9, the discharge tube 1C of the present embodiment is able to provide a remarkably stable electrical discharge.

The discharge tube 1C of the present embodiment is able to provide such remarkably stable electrical discharges even in the proximity of the transformer 4 given that the dash discharge trigger wires 50B are disposed in a portion where the first plane 31 intersects with the inner wall of the airtight cylinder 10, that is, the center portion of the airtight cylinder 10.

By forming the dash discharge trigger wires 50B of the present embodiment in the aforementioned manner, even where the magnetic field of the electromagnetic wave from the transformer 4 (generating a pulse with a higher voltage than that of a coil) may affect the discharge tube 1C, the dash discharge trigger wire 50B can restrain the current generated from electromagnetic induction to a minimal amount, and can stabilize the electric potential of the electrical discharges that are repeatedly induced by the discharge tube 1C.

Figure 18:
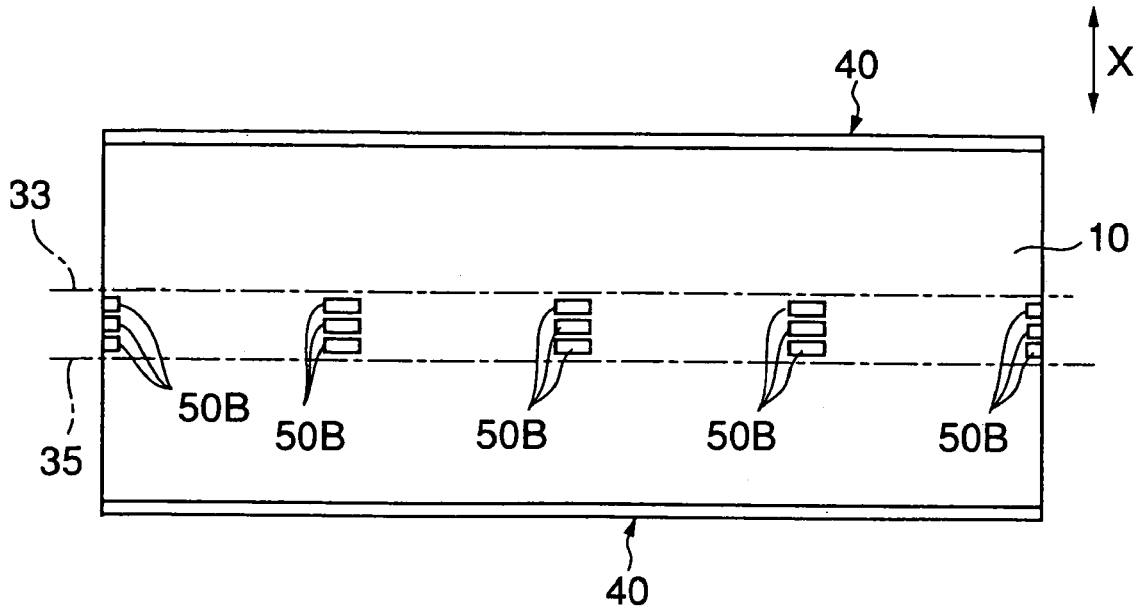
FIG. 18 is a developed view showing an inner wall of an airtight cylinder of a discharge tube according to a modified example of a second embodiment of the present invention.

FIG. 18 is a developed view showing a modified example of the discharge tube 1C of the aforementioned second embodiment. In the modified example, four dash discharge trigger wires 50B are disposed in an evenly spaced manner with a 45 degree interval, wherein the discharge trigger wires 50B are arranged in plural rows (lines) in the axial direction of the airtight cylinder 10 (direction indicated by arrow X in FIG. 18).

In obtaining the electrical discharge property of the modified example under the same conditions as the aforementioned second embodiment where plural dash discharge trigger wires 50B are disposed in the area facing the discharge gap 29 of the airtight cylinder 10 while being situated proximal to the transformer 4, an electrical discharge property that is substantially the same as that shown in FIG. 17 was attained. Therefore, the present invention is not limited to the second embodiment where dash discharge trigger wires 50B are disposed in a single line (row) manner in the center portion of the airtight cylinder 10. Instead, the dash discharge trigger wires may be disposed in a plural line manner in the area facing the discharge gap 29 of the airtight cylinder 10 (area between the second plane 33 and the third plane 35), to thereby prevent electric current from being generated by electromagnetic induction in the dash discharge trigger wires 50B even when exposed to an electric field or electromagnetic waves generated by the transformer 4. Accordingly, electric potential of the electrical discharges that are repeatedly induced in the discharge gap 29 can be stabilized.

Next, the third embodiment according to the present invention is described below.

Figure 19:
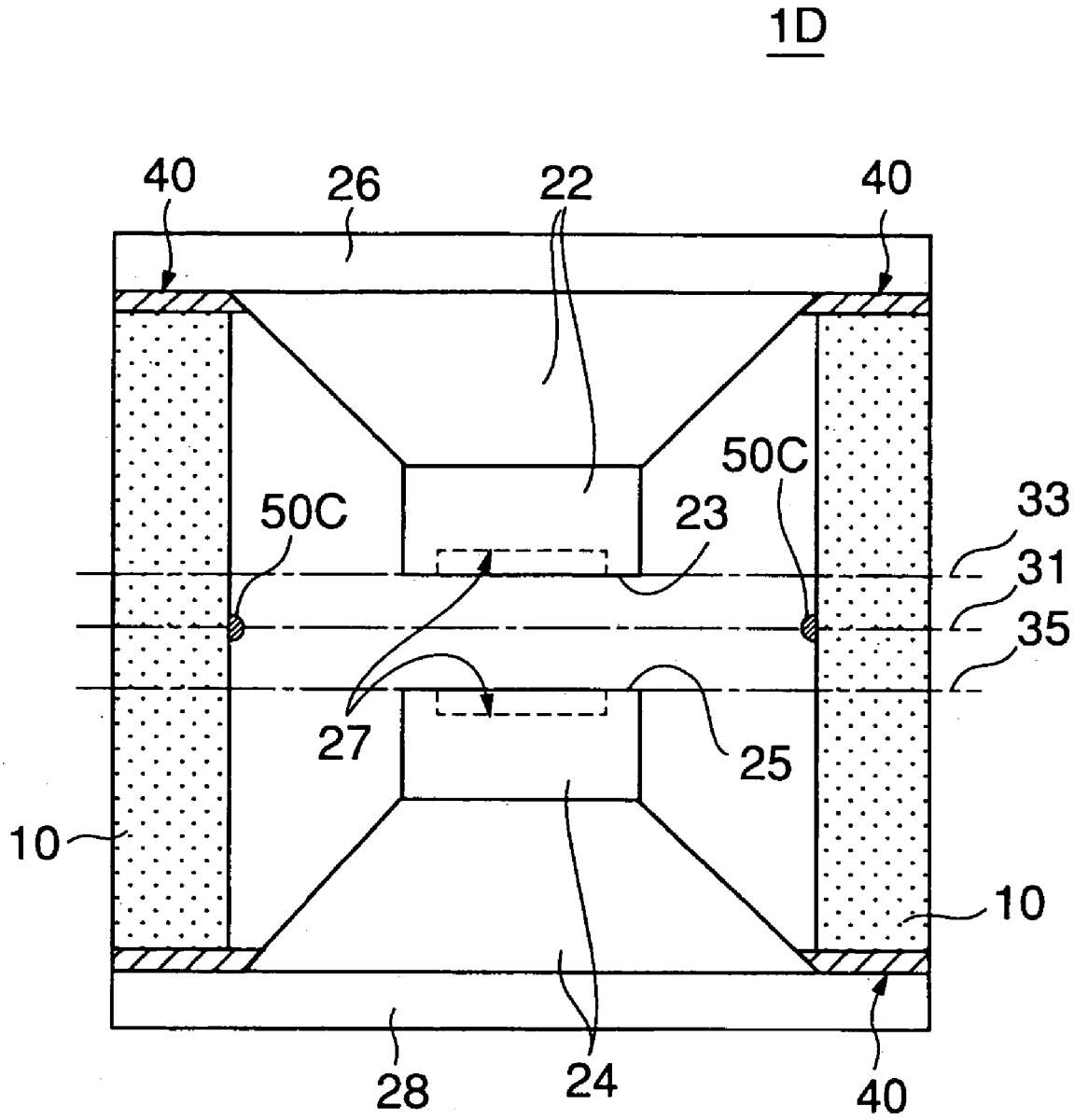
FIG. 19 is a cross-sectional view showing a discharge tube according to a third embodiment of the present invention.
Figure 20:
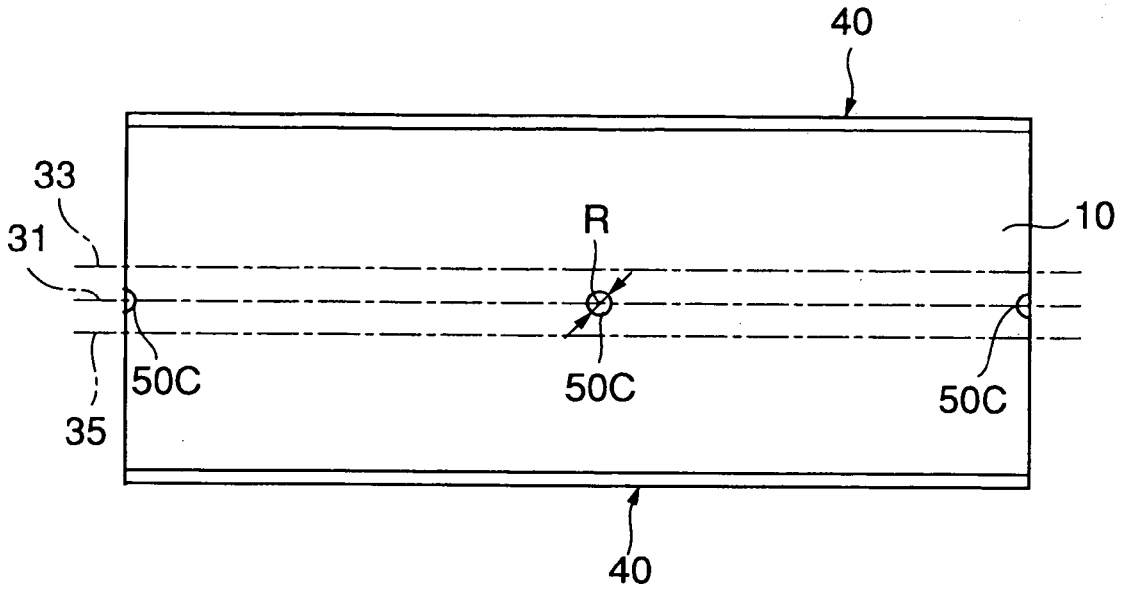
FIG. 20 is a developed view showing an inner wall of an airtight cylinder of the discharge tube shown in FIG. 19.

FIG. 19 is a cross-sectional view showing a discharge tube 1D of the third embodiment of the present invention, and FIG. 20 is a developed view showing an inner wall of the airtight cylinder 10 of the discharge tube 1D. It is to be noted that, in the description of the third embodiment of the present invention using FIGS. 19 and 20, like components are denoted by like numerals as of the description of the first embodiment using FIGS. 11, 12, and 14.

The discharge tube 1D of the present embodiment has a feature of having a plurality of discharge trigger wires 50C in the form of dots in the portion where the first plane 31 intersects with the inner wall of the airtight cylinder 10, that is, the center portion of the airtight cylinder 10. In the present embodiment, the discharge trigger wires 50C, which are formed as two dots, are disposed in an evenly spaced manner with a 180 degree interval. The dot discharge trigger wires 50C are formed with a diameter (indicated by arrow R in FIG. 20) which is, for example, no less than 0.3 mm and no more than 2 mm, so as to obtain a suitable electrical discharge property (described below).

Figure 6:
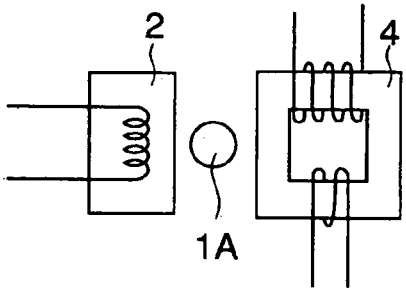
FIG. 6 is a view showing a state where a discharge tube is situated between a coil and a transformer.
Figure 7:
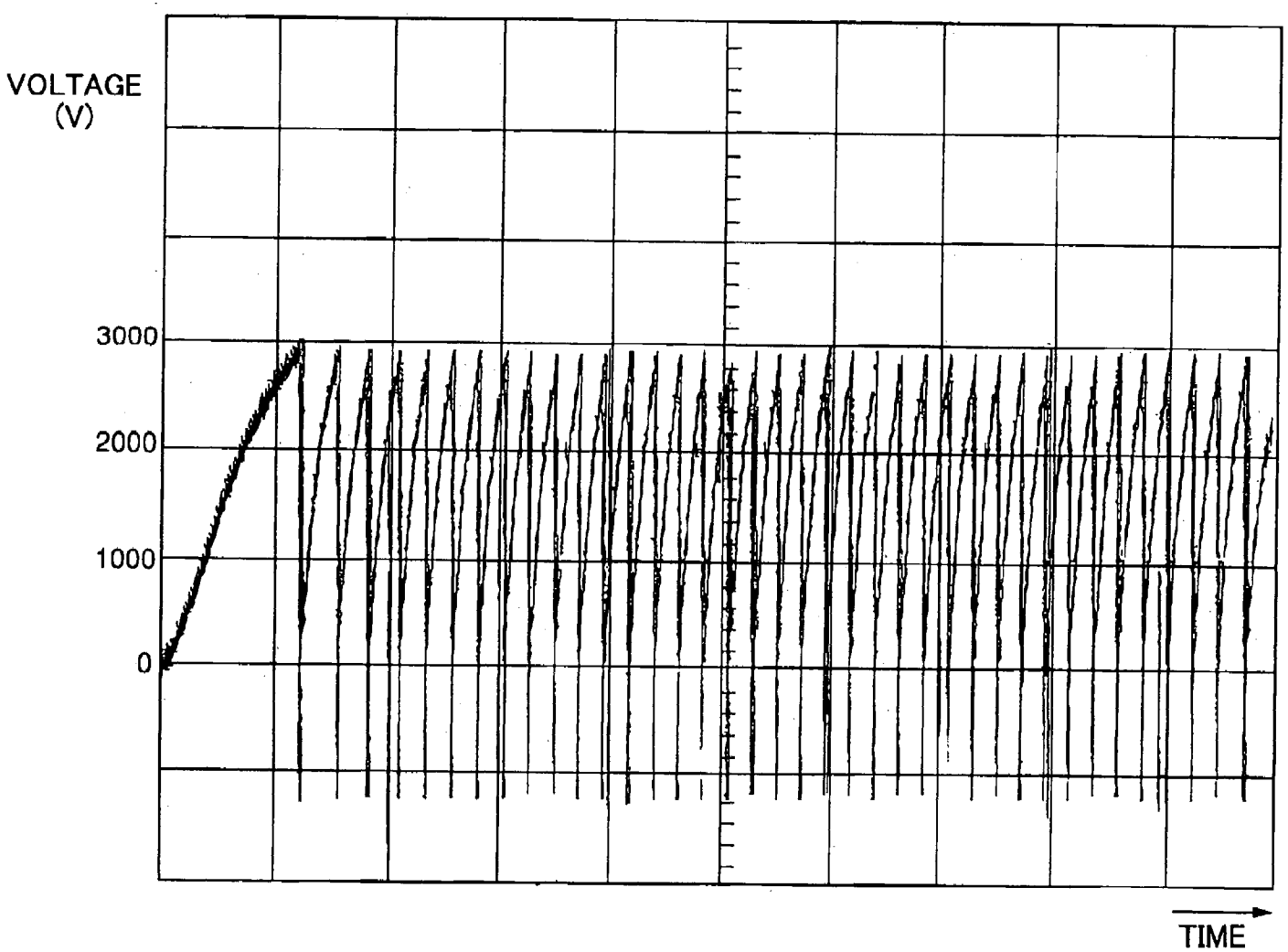
FIG. 7 is a diagram showing electrical discharge property data in a case where a single conventional discharge tube is used.
Figure 21:
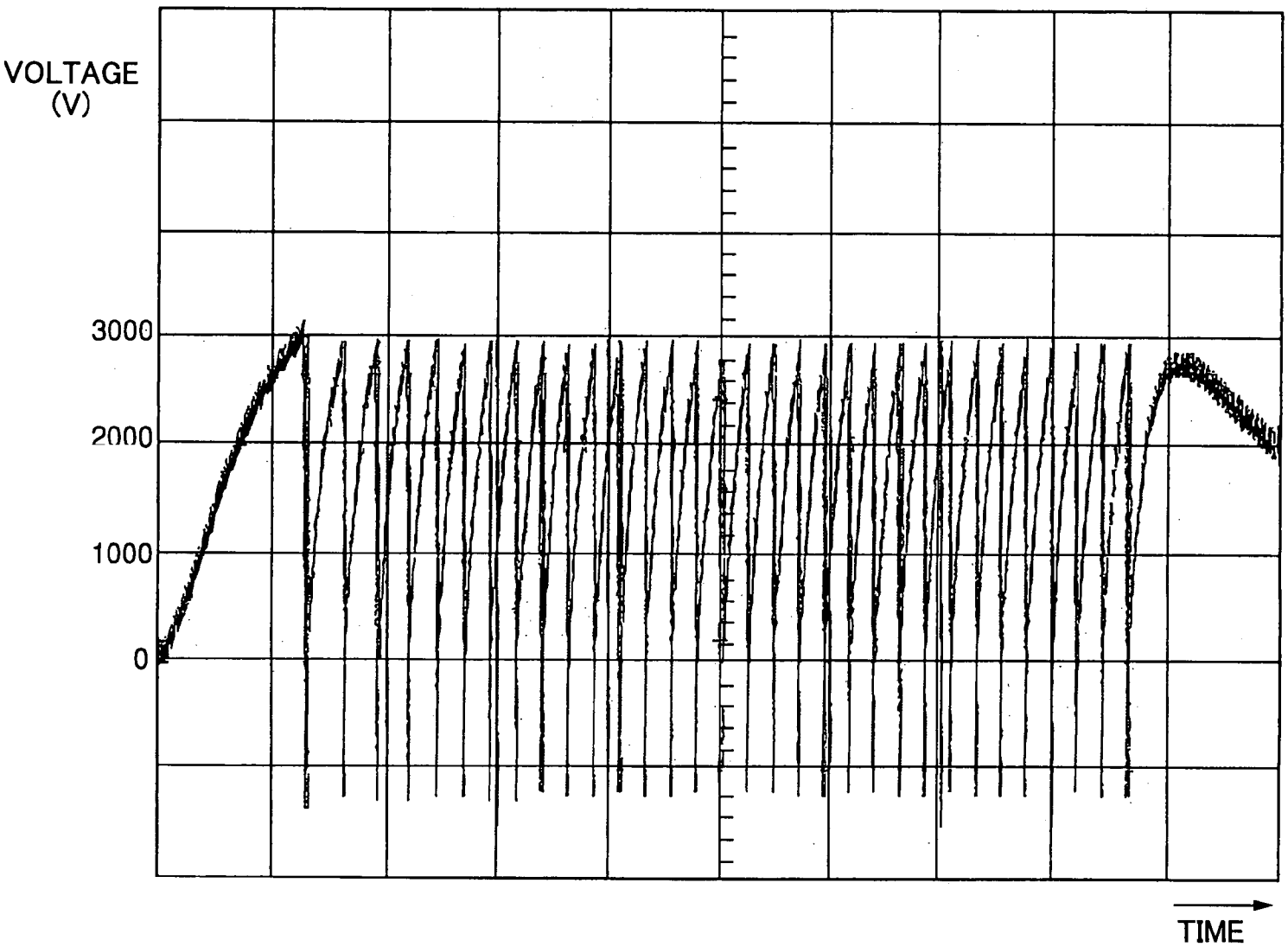
FIG. 21 is a diagram showing electrical discharge property data in a case where a discharge tube according to a third embodiment of the present invention is situated between a coil and a transformer.

FIG. 21 shows the electrical discharge property of the discharge tube 1D where electrical discharge was induced with the discharge tube 1D under the same condition as described in FIG. 6, in which the discharge tube 1D is situated between the coil 2 and the transformer 4.

More specifically, the discharge tube 1D is disposed in a manner so that the distance between the discharge tube 1D and the coil 2 or the transformer 4 is no more than 2 mm, in the illustrated exemplary embodiment. When this condition is satisfied, an electrical discharge property described below can be obtained regardless of whether the discharge tube 1D is provided to the coil 2 or the transformer 4. Further, charge from a condenser is repeatedly applied between the upper discharge electrode 22 and the lower discharge electrode 24, to thereby repeatedly generate arc discharge between the upper discharge plane 23 of the upper discharge electrode 22 and the lower discharge plane 25 of the lower discharge electrode 24. The coil and transformer described in the first and second embodiment may be employed as the coil 2 and the transformer 4 in the present embodiment.

Figure 10:
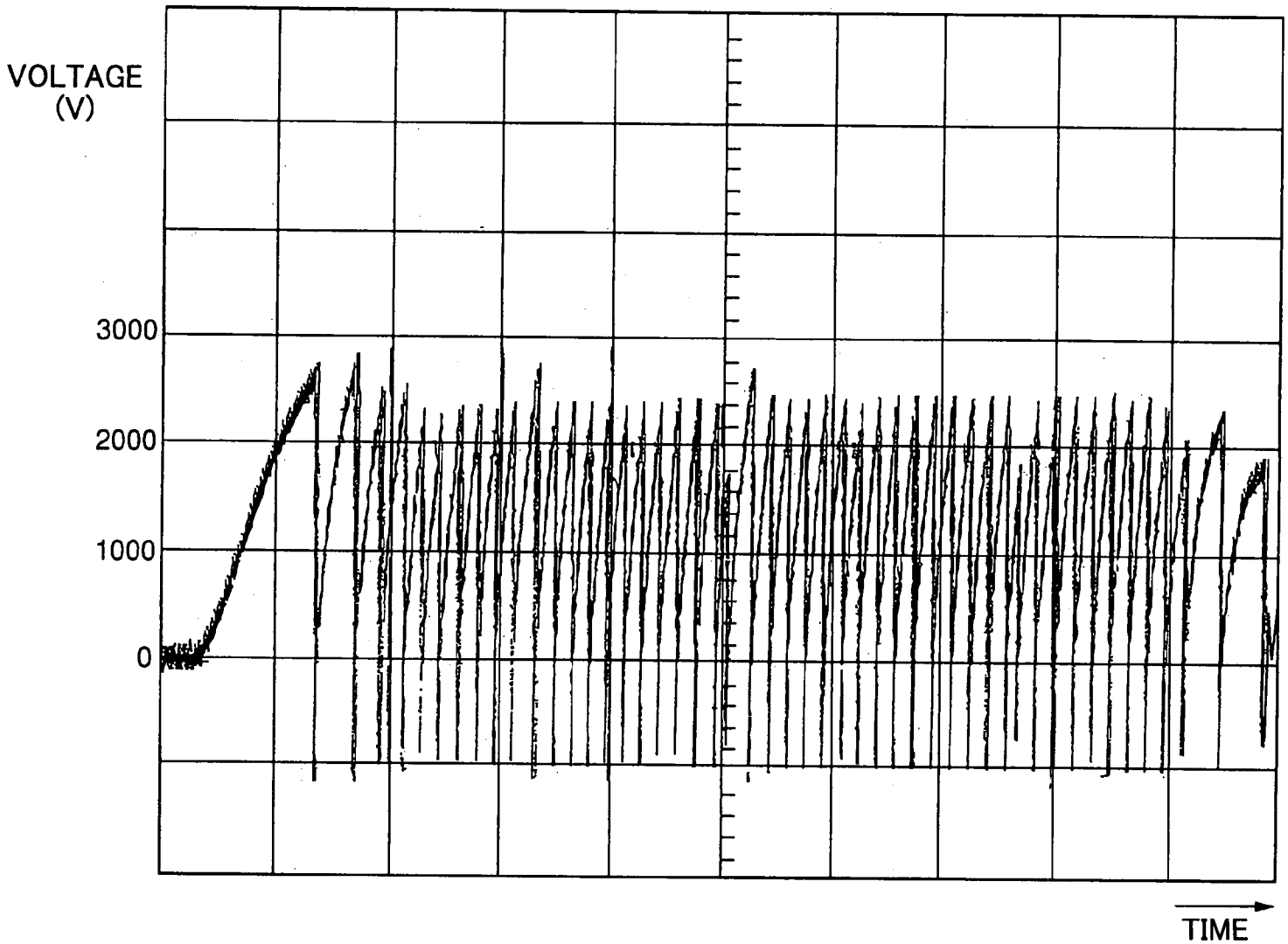
FIG. 10 is a diagram showing electrical discharge property data in a case where a conventional discharge tube is situated between a coil and a transformer.

FIG. 21 shows that the discharge tube 1D of the present embodiment is able to repeatedly and stably generate electrical discharges at a uniform electric potential even when the discharge tube 1D is situated between the coil 2 and the transformer 4. In comparison with the case of the conventional discharge tube 1A shown in FIG. 10, the discharge tube 1D of the present embodiment is able to provide remarkably stable electrical discharges.

The discharge tube 1D of the present embodiment is able to provide such remarkably stable electrical discharges even in the proximity between the coil 2 and the transformer 4 given that the dot discharge trigger wires 50C are disposed in the portion where the first plane 31 intersects with the inner wall of the airtight cylinder 10, that is, the center portion of the airtight cylinder 10.

By forming the dot discharge trigger wires 50C of the present embodiment in the aforementioned manner, even where the magnetic field of the electromagnetic wave from both the coil 2 and the transformer 4 may affect the discharge tube 1D, the dot discharge trigger wires 50C can restrain the current generated from electromagnetic induction to a minimal amount, and can stabilize the electric potential of the electrical discharges that are repeatedly induced by the discharge tube 1D.

It is to be noted that the dot discharge trigger wires 50C may be disposed in plural rows in the area facing the discharge gap 29 of the airtight cylinder 10 as in the manner similar to the aforementioned examples shown in FIGS. 14 and 18. In this case also, an electrical discharge property substantially the same as that of example shown in FIG. 21 can be attained.

Therefore, the present invention is not limited to the third embodiment where a dot discharge trigger wire 50C is disposed in a single line (row) manner in the center portion of the airtight cylinder 10 as shown in FIGS. 19 and 20. Instead, dot discharge trigger wires may be disposed in a plural row manner in the area facing the discharge gap 29 of the airtight cylinder 10 (area between the second plane 33 and the third plane 35), to thereby prevent electric current from being generated by electromagnetic induction in the dot discharge trigger wires 50C even when exposed to an electric field or electromagnetic waves generated by the coil 2 and the transformer 4. Accordingly, electric potential of the electrical discharges that are repeatedly induced in the discharge gap 29 can be stabilized.

Next, the fourth and fifth embodiments according to the present invention are described below.

Figure 22:
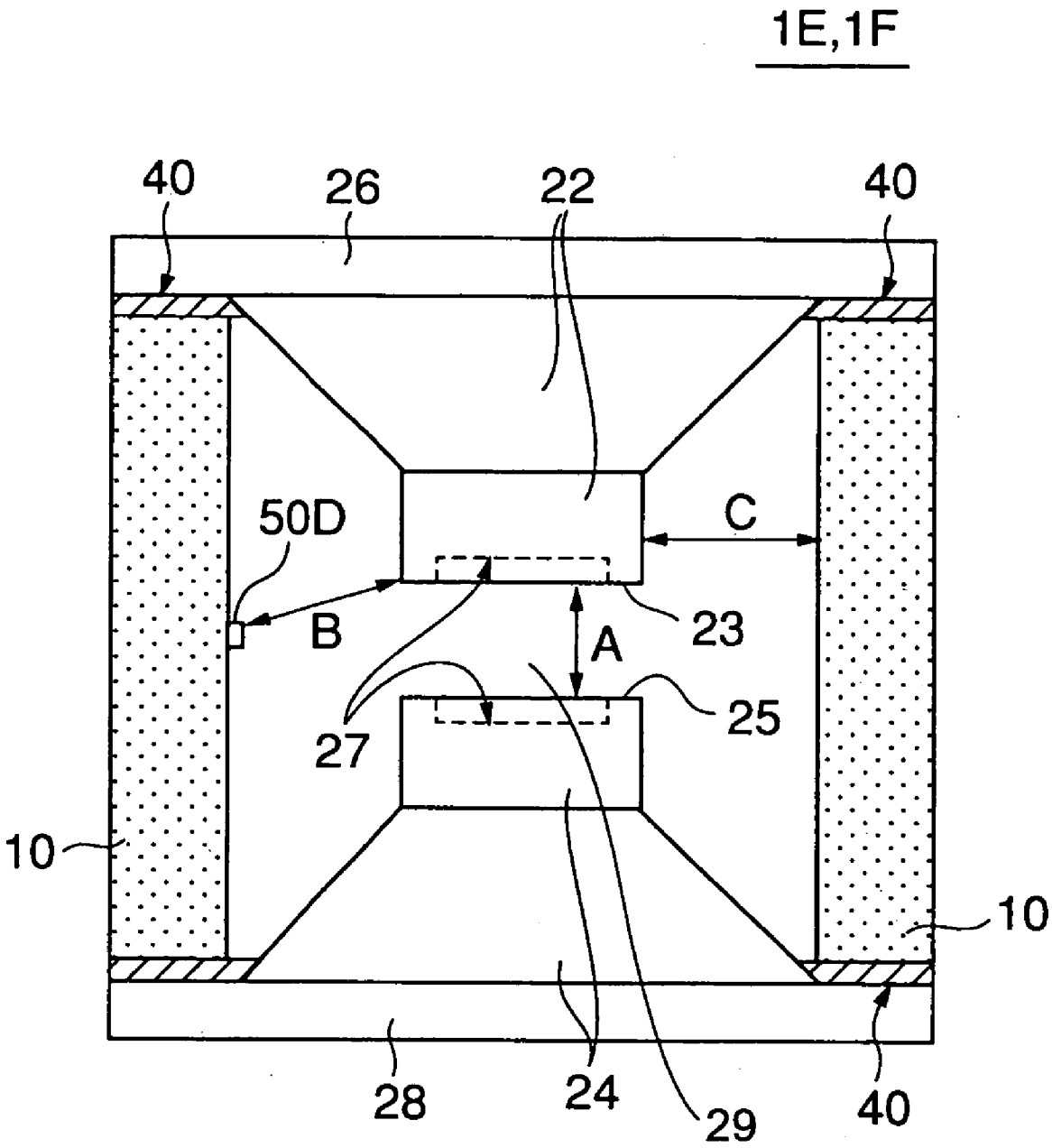
FIG. 22 is a cross-sectional view showing a discharge tube according to fourth and fifth embodiments of the present invention.

FIG. 22 is a cross-sectional view showing a, discharge tube 1E and 1F of the respective fourth and fifth embodiments according to the present invention. Since the discharge tube 1E of the fourth embodiment and the discharge tube 1F of the fifth embodiment are structured the same except for a difference of internal measurements (arrows A, B, and C in FIG. 22), both the discharge tube 1E of the fourth embodiment and the discharge tube 1F of the fifth embodiment are described together with reference to FIG. 22. It is to be noted that, in the description of the fourth and fifth embodiments of the present invention using FIG. 22, like components are denoted by like numerals as of the aforementioned first embodiment using FIGS. 11, 12, and 14.

First, the discharge tube 1E of the fourth embodiment is described below. The basic structure of the discharge tube 1E of the fourth embodiment is substantially the same as those described in the aforementioned embodiments. The discharge tube 1E basically includes, for example, the airtight cylinder 10, the upper discharge electrode 22, and the lower discharge electrode 24. Although the discharge tube 1E also has a discharge trigger wire 50D disposed at the inner wall of the airtight cylinder 10, the shape or the arrangement of the discharge trigger wire 50D is not to be limited in particular as long as the relation described below are satisfied.

The discharge tube 1E of the fourth embodiment is formed to satisfy a relation of: $A \leqq 2 \times B$, wherein the letter A is the space of the discharge gap 29 (indicated with an arrow A in FIG. 22), and the letter B is the distance from the discharge trigger wire 50D to the upper discharge plane 23 or the lower discharge plane 25 (indicated with an arrow B in FIG. 22).

Figure 23:
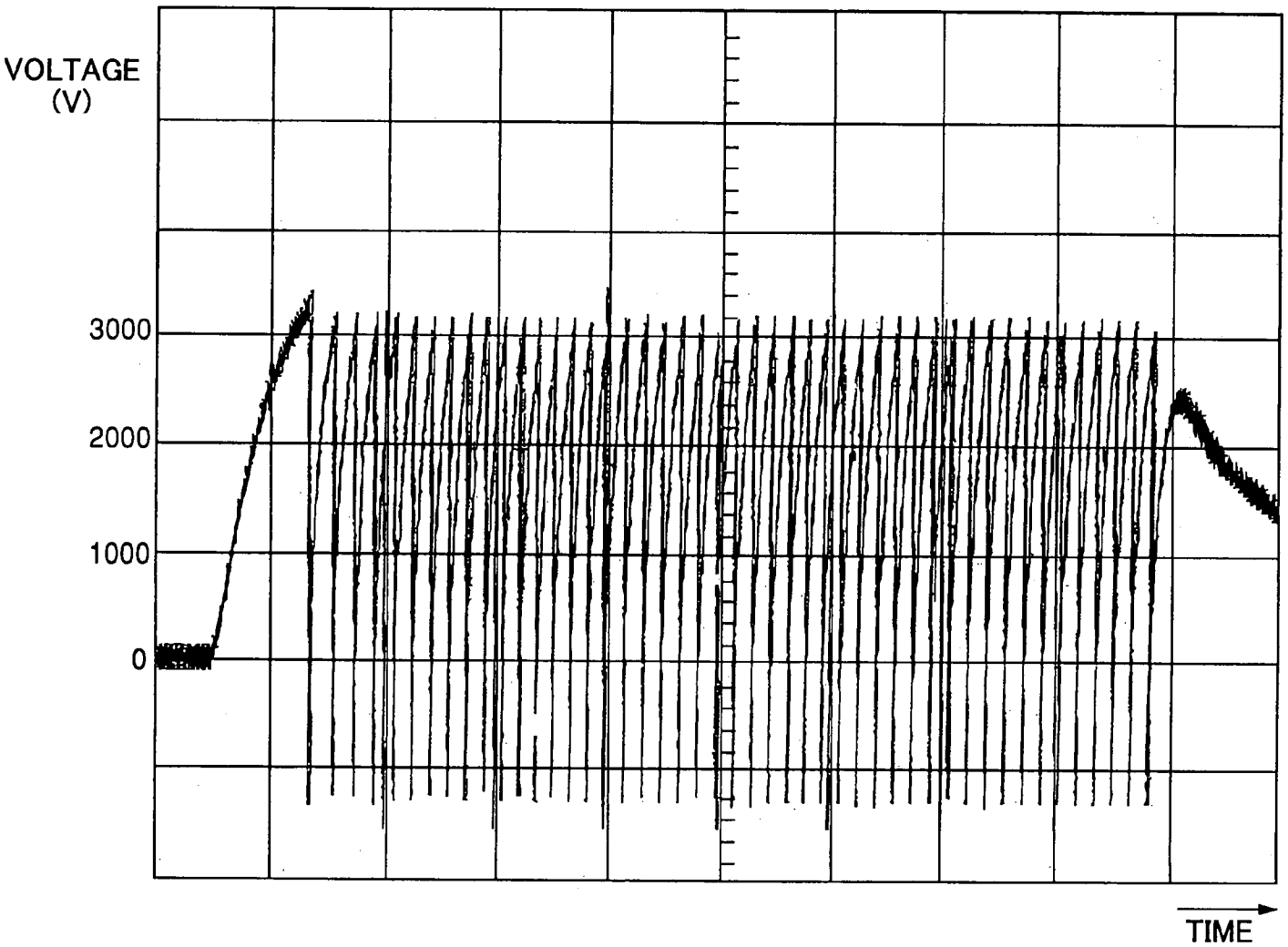
FIG. 23 is a diagram showing electrical discharge property data for a discharge tube according to the fourth embodiment of the present invention.

FIG. 23 shows the electrical discharge property in a case where a single discharge tube 1E is discharged. FIG. 23 shows that the discharge tube 1E of the fourth embodiment is able to repeatedly and stably generate electrical discharges at a uniform electric potential.

Figure 24:
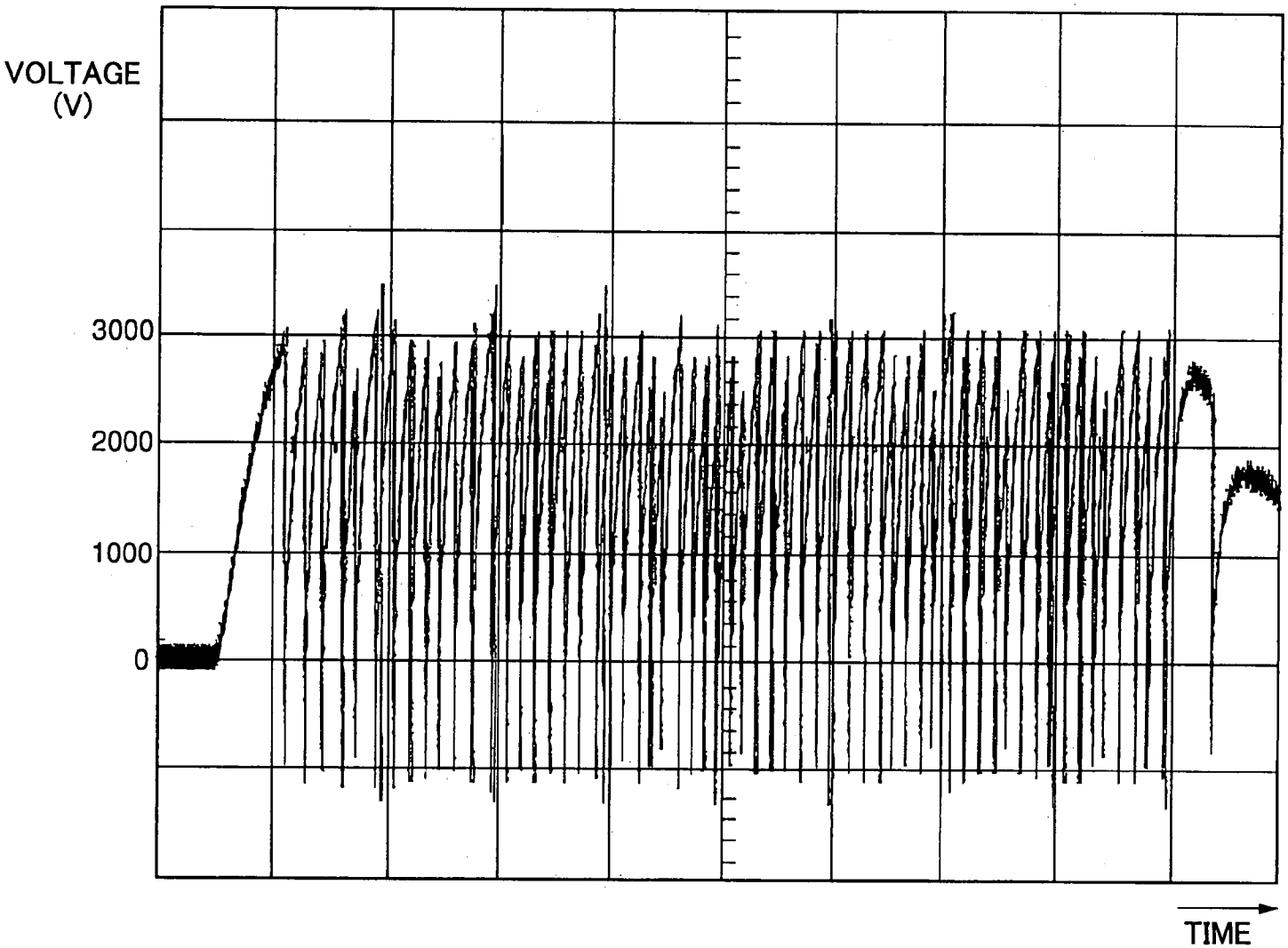
FIG. 24 is a diagram showing electrical discharge property data of a comparative example with respect to the electrical discharge property data shown in FIG. 23.

As a way of comparison, a discharge tube that satisfies $A > 2 \times B$ (hereinafter referred to as first test discharge tube) was prepared. FIG. 24 shows the electrical discharge property in a case where a single first test discharge tube is discharged. FIG. 24 shows the first test discharge tube exhibiting an electrical discharge with an unstable electric potential that fluctuates largely.

The remarkable electrical discharge property of the discharge tube 1E of the fourth embodiment is attained owing that the space A and the distance B satisfies a relation of $A \leqq 2 \times B$, that is, the distance B is two times or more of the space A.

Therefore, even where sputter adheres to the inner wall portion of the airtight cylinder 10 at a time of discharge, or where external electric fields or the like create an electric current in the discharge trigger wire 50D, neither the sputter nor the induced current will adversely affect the electrical discharge induced in the discharge gap 29. Accordingly, the electric potential of the electrical discharges that are repeatedly induced in the discharge gap 29 can be stabilized.

Next, the discharge tube 1F of the fifth embodiment is described below. The basic structure of the discharge tube 1F of the fifth embodiment is substantially the same as those described in the aforementioned embodiments except as those described herein. The discharge tube 1F basically includes, for example, the airtight cylinder 10, the upper discharge electrode 22, and the lower discharge electrode 24. In the fifth embodiment, the discharge tube 1F may be formed with or without a discharge trigger wire at the inner wall of the airtight cylinder 10.

The discharge tube 1F of the fifth embodiment is formed to satisfy a relation of: $A \leqq 2 \times C$, wherein the letter A is the space of the discharge gap 29 (indicated with an arrow A in FIG. 22), and the letter B is the distance from the inner wall of the airtight cylinder 10 to the upper discharge plane 23 or the lower discharge plane 25 (indicated with an arrow B in FIG. 22).

Figure 25:
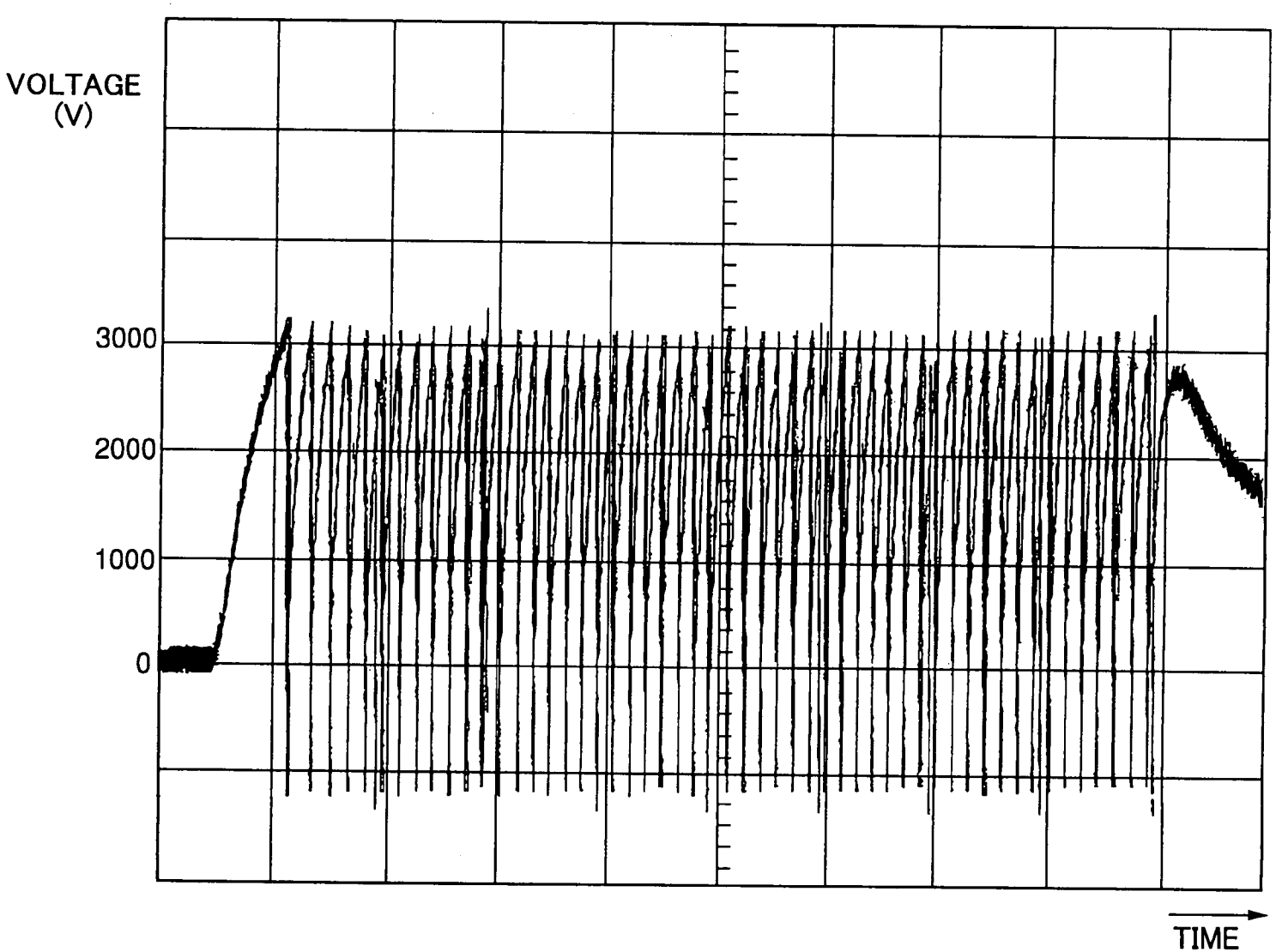
FIG. 25 is a diagram showing electrical discharge property data for a discharge tube according to a fifth embodiment of the present invention.

FIG. 25 shows the electrical discharge property in a case where a single discharge tube 1F is discharged. FIG. 25 shows that the discharge tube 1F of the fifth embodiment is able to repeatedly and stably induce electrical discharges at a uniform electric potential.

Figure 26:
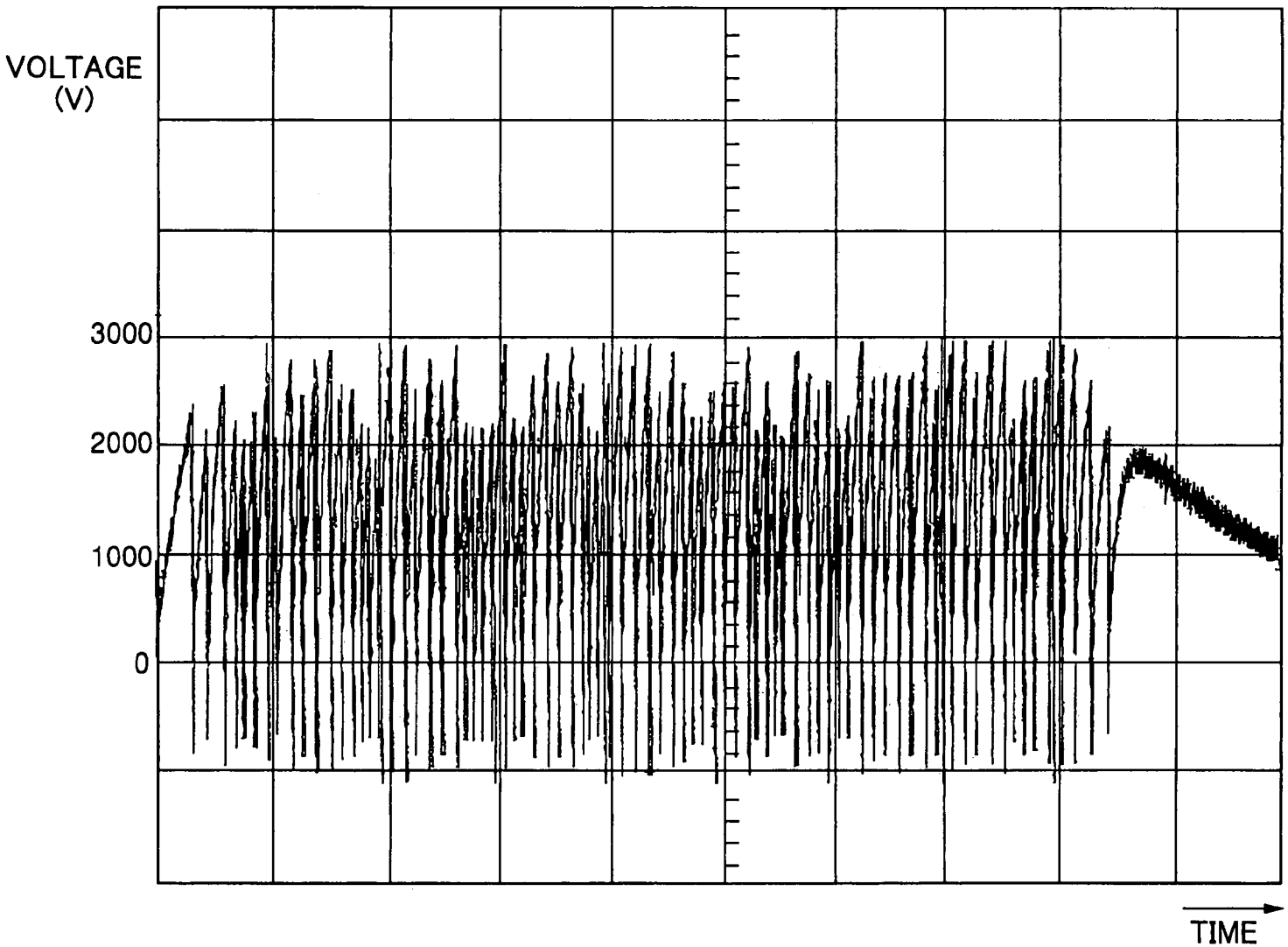
FIG. 26 is a diagram showing electrical discharge property data of a comparative example with respect to the electrical discharge property data shown in FIG. 25.

As a way of comparison, a discharge tube that satisfies $A > 2 \times C$ (hereinafter referred to as second test discharge tube) was prepared. FIG. 26 shows the electrical discharge property in a case where a single second test discharge tube is discharged. FIG. 26 shows the second test discharge tube exhibiting an electrical discharge with an unstable electric potential that fluctuates largely.

The remarkable electrical discharge property of the discharge tube 1F of the fifth embodiment is attained owing that the space A and the distance C satisfies a relation of $A \leqq 2 \times C$, that is, the distance C is two times or more of the space A.

Therefore, even where sputter adheres to the inner wall portion of the airtight cylinder 10 at a time of discharge, the sputter will not adversely affect the discharge generated in the discharge gap 29. Accordingly, the electric potential of the electrical discharges that are repeatedly induced in the discharge gap 29 can be stabilized.

Further, the present invention is not limited to these embodiments, but various variations and modifications may be made without departing from the scope of the present invention.

The present application is based on Japanese Priority Application No. 2003-003505 filed on Jan. 9, 2003 with the Japanese Patent Office, the entire contents of which are hereby incorporated by reference.

What is claimed is:

1. A discharge tube comprising:

a cylinder having first and second end planes;

first and second discharge electrodes coupled to the respective first and second end planes, the first and second discharge electrodes having respective upper and lower discharge planes forming therebetween a discharge gap; and one or more discharge trigger wires disposed in a portion of the cylinder that encompasses the discharge gap;

wherein the discharge tube is situated no more than 2 mm from at least one of a coil and a transformer;

wherein the one or more discharge trigger wires are uniformly situated on the first plane that perpendicularly intersects with the axial direction of the cylinder; and wherein all discharge trigger wires disposed in the cylinder are oriented in a direction perpendicularly intersects the axial direction of the cylinder.

2. The discharge tube as claimed in claim 1, wherein at least one of the discharge trigger wires has a ring shape.

3. The discharge tube as claimed in claim 1, wherein the one or more discharge trigger wires are disposed in a center portion of the cylinder.

4. The discharge tube as claimed in claim 1, wherein the one or more discharge trigger wires are disposed in an area facing the discharge gap.

5. The discharge tube as claimed in claim 1, wherein the one or more discharge trigger wires comprises a plurality of discharge trigger wires and each of the discharge trigger wires has a dash shape.

6. The discharge tube as claimed in claim 5, wherein the length of each of the discharge trigger wires is no more than 2 mm and no less than 0.3 mm.

7. The discharge tube as claimed in claim 1, wherein the one or more discharge trigger wires comprises a plurality of discharge trigger wires and each of the discharge trigger wires has a dot shape.

8. The discharge tube as claimed in claim 7, wherein the diameter of each of the discharge trigger wires is no more than 2 mm and no less than 0.3 mm.

9. The discharge tube as claimed in claim 1, wherein a relation of $A \leqq 2 \times B$ is satisfied in a case where A is the distance of the space between the upper and lower discharge planes, and B is the distance from the discharge trigger wire to the upper discharge plane or the lower discharge plane.

10. A discharge tube comprising:

a cylinder having first and second end planes and an inner wall; and first and second discharge electrodes coupled to the respective first and second end planes, the first and second discharge electrodes having respective upper and lower discharge planes;

wherein a relation of $A \leqq 2 \times$ is satisfied in a case where A is the distance between the upper and lower discharge planes, and C is the distance from the inner wall of the cylinder to the upper discharge plane or the lower discharge plane; end wherein the discharge tube is situated no more than 2 mm from at least one of a coil and a transformer;

wherein the upper and lower discharge planes form a discharge gap there between, and further including one or more discharge trigger wires disposed in a portion that encompasses the discharge gap;

wherein the one or more discharge trigger wires are uniformly situated on the first plane that perpendicularly intersects with the axial direction of the cylinder; and wherein all discharge trigger wires disposed in the cylinder are oriented in a direction that perpendicularly intersects with the axial direction of the cylinder.

* * * * *